US010033084B2

(12) United States Patent
Li et al.

(10) Patent No.: US 10,033,084 B2
(45) Date of Patent: Jul. 24, 2018

(54) OPERATION FREQUENCY BAND CUSTOMIZABLE AND FREQUENCY TUNABLE FILTERS WITH EBG SUBSTRATES

(71) Applicant: THE REGENTS OF THE UNIVERSITY OF CALIFORNIA, Oakland, CA (US)

(72) Inventors: Guann-Pyng Li, Irvine, CA (US); Yu Guo, Irvine, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 178 days.

(21) Appl. No.: 14/937,811

(22) Filed: Nov. 10, 2015

(65) Prior Publication Data

US 2016/0134253 A1 May 12, 2016

Related U.S. Application Data

(60) Provisional application No. 62/077,717, filed on Nov. 10, 2014.

(51) Int. Cl.
*H01P 1/20* (2006.01)
*H01P 7/06* (2006.01)

(52) U.S. Cl.
CPC ..... *H01P 7/065* (2013.01); *H01P 1/2005* (2013.01)

(58) Field of Classification Search
CPC ..... H01P 1/2005; H01P 7/065
USPC ..... 333/202, 203, 206, 207, 209
See application file for complete search history.

(56) References Cited

U.S. PATENT DOCUMENTS 5,389,903 A * 2/1995 Piirainen ..... H01P 1/205 333/203
6,320,482 B1 * 11/2001 Ala-Kojola ..... H01P 1/2053 333/202
8,354,975 B2 * 1/2013 Ando ..... H01Q 9/0421 333/202

OTHER PUBLICATIONS

Guo, Y, et al., "A Compact Configurable EBG Filter on PCB", IEEE Transactions on Components, Packaging and Manufacturing Technology, 2015, vol. 5, No. 5, pp. 668-674.
Guo, Y., et al., "A compact and customizable operation frequency filter for broadband applications", IEICE Electronics Express, 2015, vol. 12, No. 16, pp. 1-8.

* cited by examiner

*Primary Examiner* — Stephen E Jones
(74) *Attorney, Agent, or Firm* — One LLP

(57) ABSTRACT

A cavity resonator or filter constructed on electromagnetic bandgap (EBG) substrate is provided that includes an external controlling assemble having a plurality of components configured to change a working frequency of the cavity resonator or filter. A dual-band bandpass filter is provided that includes two or more single band filters on a single EBG substrate and an external controlling assemble having a plurality of components configured to change a working frequency of the cavity resonator or filter.

18 Claims, 44 Drawing Sheets

Figure 13b of appendix

100

100

Figure 13b of appendix

100

100

200

200

200

300

400

500

600

800

900

1000

1200

1400

1400

1400

1500

1500

1500

1600

1700

2200

OPERATION FREQUENCY BAND CUSTOMIZABLE AND FREQUENCY TUNABLE FILTERS WITH EBG SUBSTRATES

CROSS-REFERENCE TO RELATED APPLICATIONS

The present application claims priority to U.S. Provisional Patent Application Ser. No. 62/077,717 titled "OPERATION FREQUENCY BAND CUSTOMIZABLE AND FREQUENCY TUNABLE FILTERS WITH EBG SUBSTRATES" and filed on Nov. 10, 2014, the contents of which are hereby incorporated by reference in their entirety.

FIELD

The present disclosure relates to cavity resonators and filters for processing electromagnetic signals (RF signal in general) and, in particular, to a cavity resonator or filter constructed on electromagnetic bandgap (EBG) substrate that includes an external controlling assemble having a plurality of components configured to change a working frequency of the cavity resonator or filter. The present disclosure further relates to a dual-band filter constructed on EBG substrate that includes multiple single band filters and external capacitors.

BACKGROUND INFORMATION

Multiple frequency bands for wireless communication have been used in smart phones or tablets. For example, a smart phone could include an RF frequency band to cover such services as GSM, GPS, WiFi, Bluetooth, 3G or 4G LTE. A compact bandpass RF/microwave filter which can cover multiple working frequency bands is an essential component for enabling a more integrated solution for these communication handheld devices.

WiMax has also attracted much attention for long-range wireless network, especially for broadband wireless access in the frequencies from 2 to 11 GHz supported by the IEEE802.16 standard. A compact bandpass RF/microwave filter which can cover ultra wide working frequency range from 2 to 11 GHz is an essential component for WiMax communication handheld devices.

In order to achieve a wide working frequency range, different kinds of filters have been proposed and studied intensively. For planar microstrip filters, working frequencies of 4.14-6.26 GHz and 1.178-3.6 GHz have been demonstrated by filters with footprints of about 17×20 $mm^2$ and 13×18 $mm^2$ respectively. However, due to the utilization of quarter wavelength resonators, a planar microstrip filter doesn't have the capability of covering a very wide working frequency range. In contrast, capacitive-post loaded evanescent mode cavities were demonstrated to be capable of having a wider working frequency of 0.98-3.48 GHz and 1.9-5 GHz by sizes of 41.5×24.9×3.17 $mm^3$ and 30.0×18.0×4.5 $mm^3$ respectively. Furthermore, when micro-fabricated in Silicon, such a filter design showed a size of 10.0×5.0×2.5 $mm^3$ and working frequency of 6 to 24 GHz.

However, its return loss and insertion loss was not satisfactory due to the limitation of a relatively narrow band energy coupling capability of the cavity structure.

Electromagnetic Bandgap (EBG) filters have also emerged as an alternative design attributed to their high Qu, ease of integration and low cost. However, these proposed EBG filters/resonators were implemented by modification of the periodic lattice in the EBG substrate which limits their use for broad band coverage.

Further, more wireless systems are calling for multifunctional or multiband operations with the support of a single broadband transceiver module. A multiband bandpass filter with compact size, planar configuration, and high performance is an integral part of a single transceiver implementation architecture.

Multiband filters have been researched extensively and their implementations can be classified into three main categories. The first category includes using two or more resonators with controllable fundamental and higher order resonant modes, such as stepped impedance resonators (SIR) in dual band bandpass filters (BPF), stub loaded SIR in dual band BPF, stub loaded resonator in dual band BPFs, and quad mode resonators in quad band BPFs. Generally, the nth resonant modes of each resonator need appropriate coupling for building up the nth pass band. Since the resonant modes of such resonators are often dependent on each other, this method sometimes is difficult to place some resonant modes in desired or useful frequencies.

The second category includes the dual mode multiple band BPF for multiple band applications. This candidate has been attractive because of its compact size, simple physical layout, and design procedure. However, the dual mode multiple band BPFs using a single resonator have reported a poor band to band isolation and notch like upper stopband of the second pass band.

The third category of multiband filters includes multiple independently constructed single band filters working at specifically selected frequencies combined to implement a multiple band filter by sharing input and output ports. A good isolation between those bands has been achieved, however, the filters usually have an area multiple times larger than that of the single band filters.

SUMMARY

The embodiments provided herein are directed to a cavity resonator or filter constructed on electromagnetic bandgap (EBG) substrate that includes an external controlling assemble having a plurality of components configured to change a working frequency of the cavity resonator or filter.

In one embodiment, a cavity resonator/filter includes posts that serve as the periodic lattice structure. The posts go through a substrate and connect a bottom metal layer with a top metal layer. The periodic lattice structure and metal layers define a resonating cavity. Controllably capacitive or inductive coupling is introduced by externally attached or built in elements.

In another embodiment, a controllable cavity resonator/filter includes an energy input and output coupling structure, a cavity structure and a controllable reactance structure.

In yet another embodiment, a controllable cavity resonator/filter includes a substrate, metal layers above and below the substrate, an array of posts, a cap structure, and capacitive or inductive control elements.

In yet another embodiment, a compact dual-band filter includes two single band filters and a set of external capacitors sharing a common EBG substrate.

The systems, methods, features and advantages of the invention will be or will become apparent to one with skill in the art upon examination of the following figures and detailed description. It is intended that all such additional methods, features and advantages be included within this description, be within the scope of the invention, and be protected by the accompanying claims. It is also intended that the invention is not limited to require the details of the example embodiments.

BRIEF DESCRIPTION OF THE FIGURES

The accompanying drawings, which are included as part of the present specification, illustrate the presently preferred embodiment and, together with the general description given above and the detailed description of the preferred embodiment given below, serve to explain and teach the principles of the present invention.

Figure 1A:
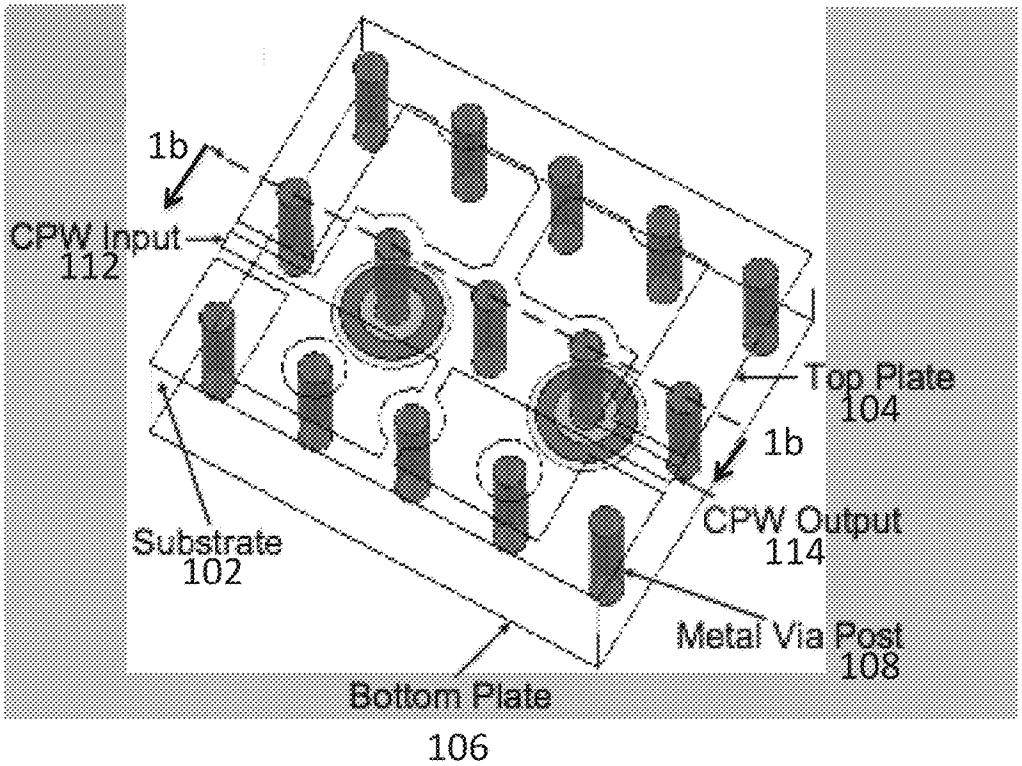
FIG. 1*a* illustrates a 3-dimensional view of a schematic of a filter with built in capacitors directly on an EBG substrate according to one embodiment of the present invention.

It should be noted that the figures are not necessarily drawn to scale and that elements of similar structures or functions are generally represented by like reference numerals for illustrative purposes throughout the figures. It also should be noted that the figures are only intended to facilitate the description of the various embodiments described herein. The figures do not necessarily describe every aspect of the teachings disclosed herein and do not limit the scope of the claims.

DESCRIPTION

The embodiments provided herein are directed to a cavity resonator or filter constructed on electromagnetic bandgap (EBG) substrate that includes an external controlling assemble having a plurality of components configured to change a working frequency of the cavity resonator or filter. The embodiments further are directed to a dual-band bandpass filter on an EBG substrate that includes two or more single bandpass filters and external capacitors.

FIG. 1*a* illustrates a 3-dimensional view of a schematic of a cavity resonator/filter 100 with built in capacitors directly on an EBG substrate according to one embodiment of the present invention.

Figure 1B:
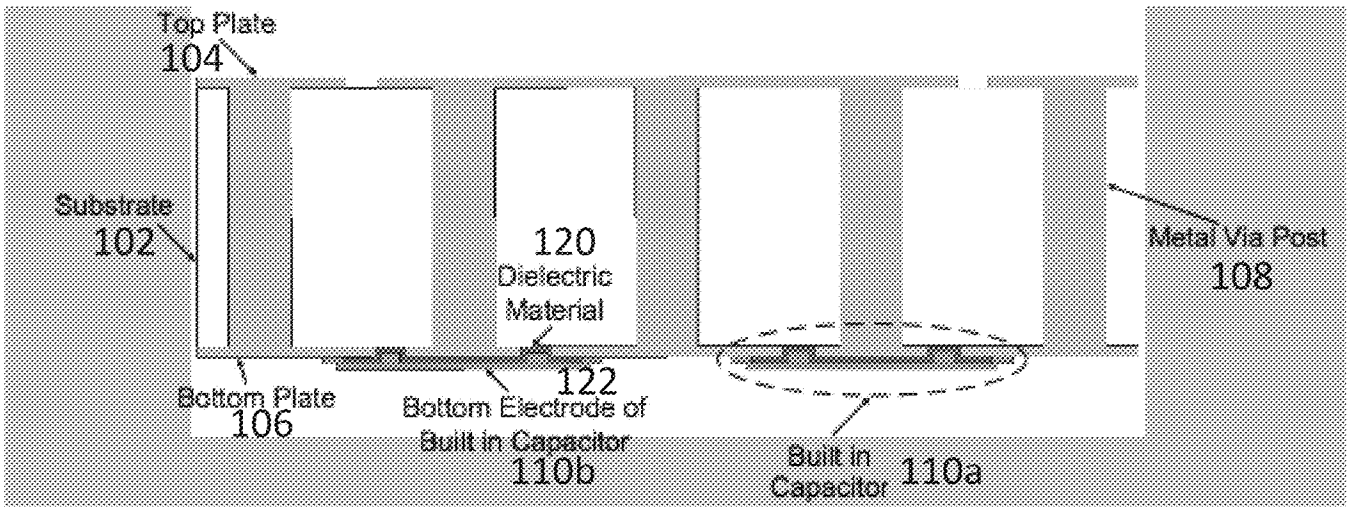
FIG. 1*b* illustrates a cross section view of the filter depicted in FIG. 1*a* taken along line 1*b*-1*b*.
Figure 1C:
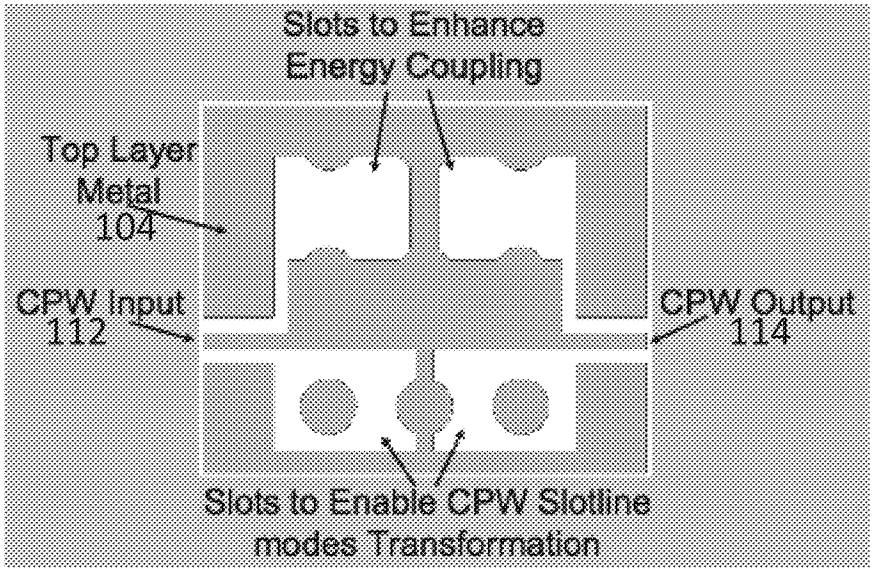
FIG. 1*c* illustrates a top view of the metal layer of the filter depicted in FIG. 1*a*.
Figure 1D:
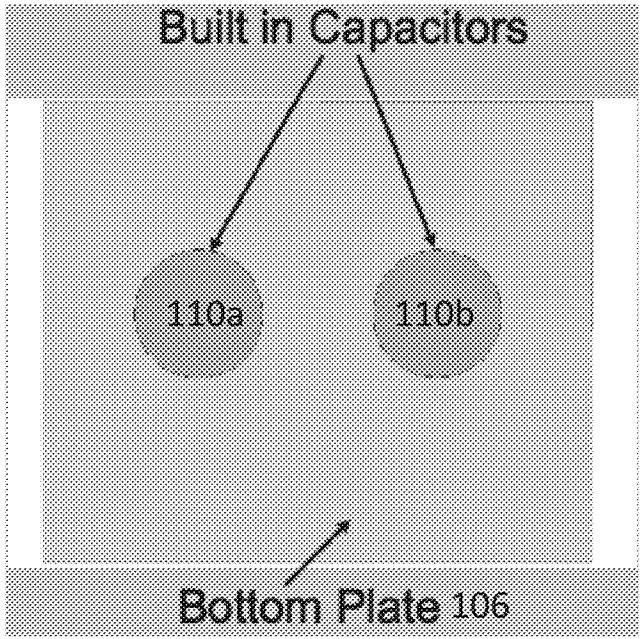
FIG. 1*d* illustrates a bottom view of the metal layer of the filter depicted in FIG. 1*a*.

FIG. 1*b* illustrates a cross section view of the filter 100 depicted in FIG. 1*a*. FIG. 1*c* illustrates a top view of the metal layer of the filter 100 depicted in FIG. 1*a*. FIG. 1*d* illustrates a bottom view of the metal layer of the filter 100 depicted in FIG. 1*a*.

According to one embodiment of the present disclosure, the cavity resonator/filter 100 includes a substrate 102, a top metal layer 104 and a bottom metal layer 106. Posts 108 serve as the periodic lattice structure in the substrate 102 and the top 104 and bottom layers 106. The filter 100 further includes built in capacitors 110*a* and 110*b*. Built in capacitors 110*a* and 110*b* include dielectric material 120 and a bottom electrode 122. The posts 108 go through the substrate 102 and connect the bottom layer 106 with the top layer 104. The periodic lattice structure (of posts 108) and the top and bottom metal layers 104 and 106 define a resonating cavity. Controllable capacitive or inductive coupling is introduced by built in elements 110*a* and 110*b*. The filter further includes an input 112 and an output 114. CPW and slotline structures are designed on the top metal layer 104 of the cavity to enable input and output energy coupling.

Figure 2A:
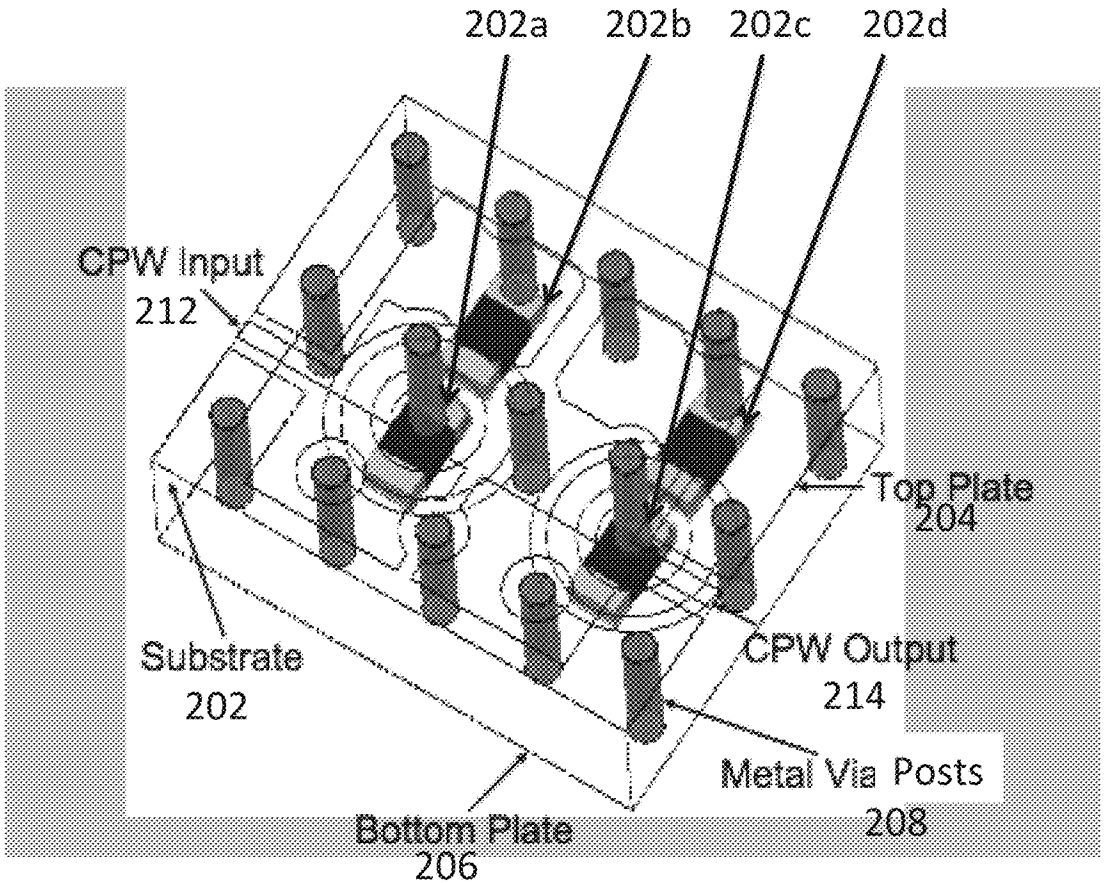
FIG. 2*a* illustrates a 3-dimensional schematic of a tunable filter implementation according to one embodiment of the present invention.

FIG. 2*a* illustrates a 3-dimensional schematic of a tunable filter 200 implemented according to one embodiment of the present invention. The tunable filter 200 follows a similar design as found in FIG. 1*a*, however the tunable filter 200 includes external components whereas the cavity resonator/filter 100 includes built-in capacitors 110*a* and 110*b*.

Figure 2B:
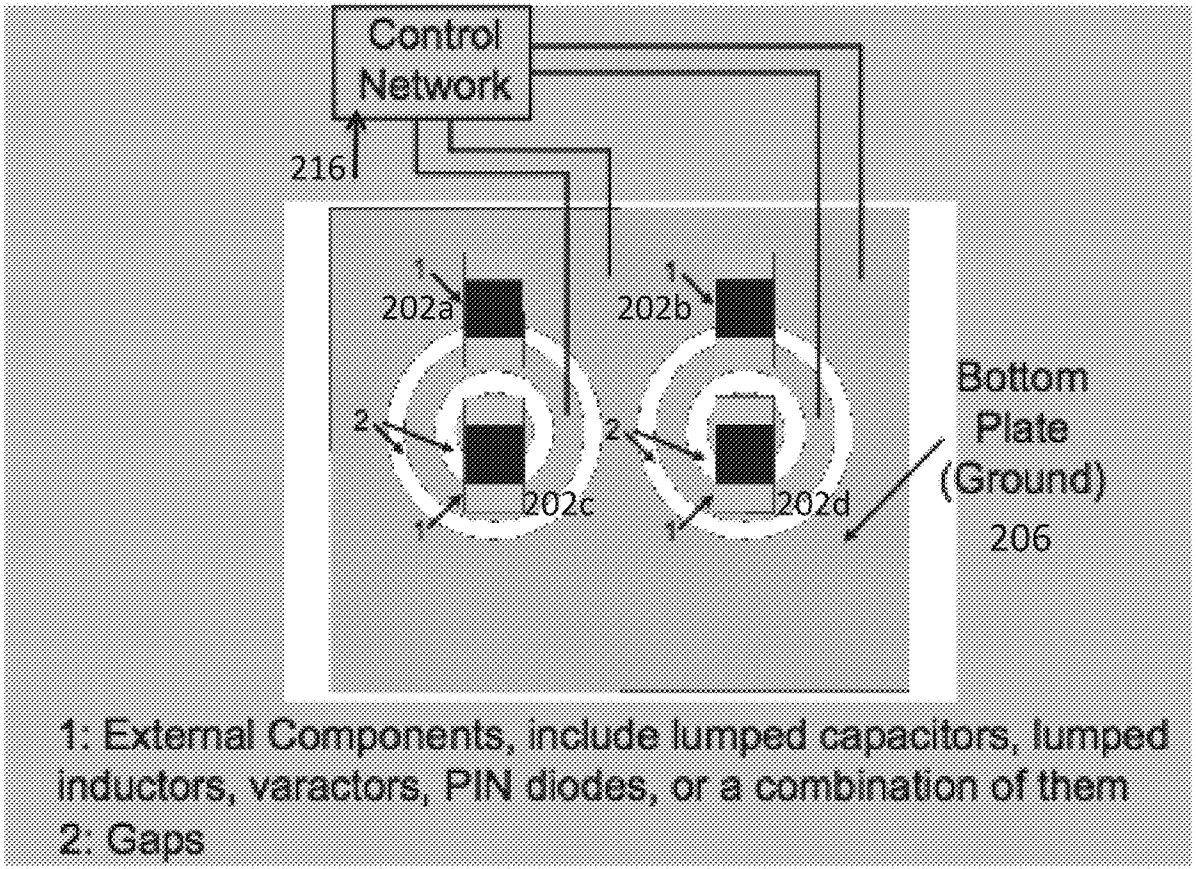
FIG. 2*b* illustrates a bottom view of the filter depicted in FIG. 2*a*.
Figure 2C:
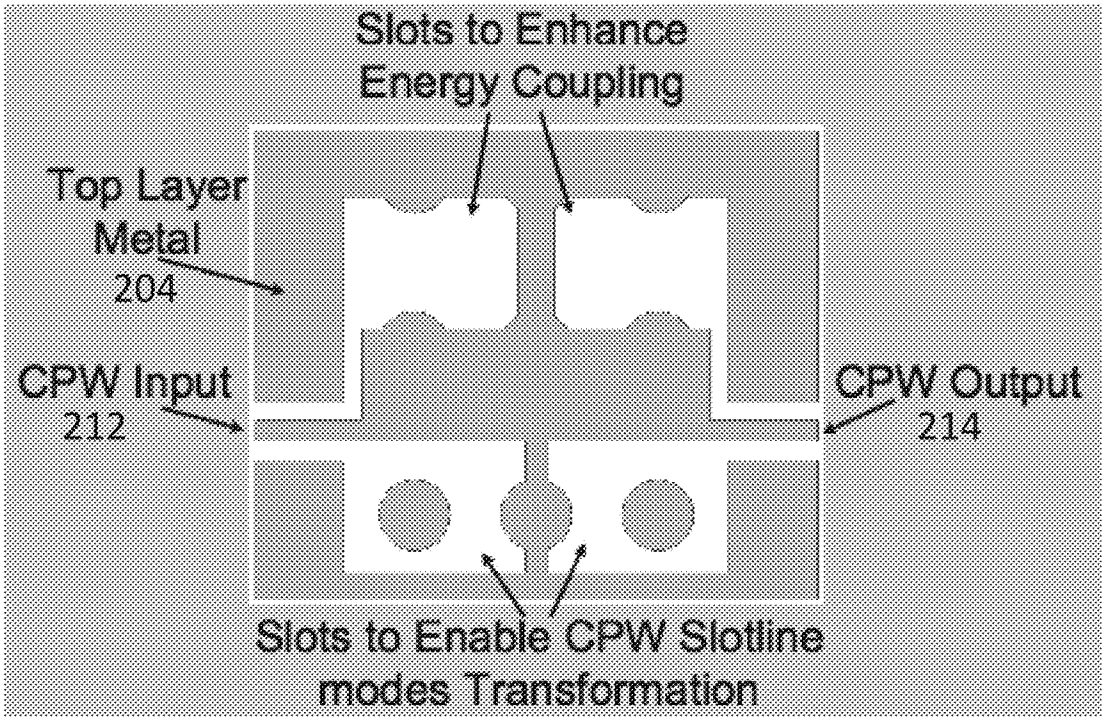
FIG. 2*c* illustrates a top view of the filter depicted in FIG. 2*a*.
Figure 2D:
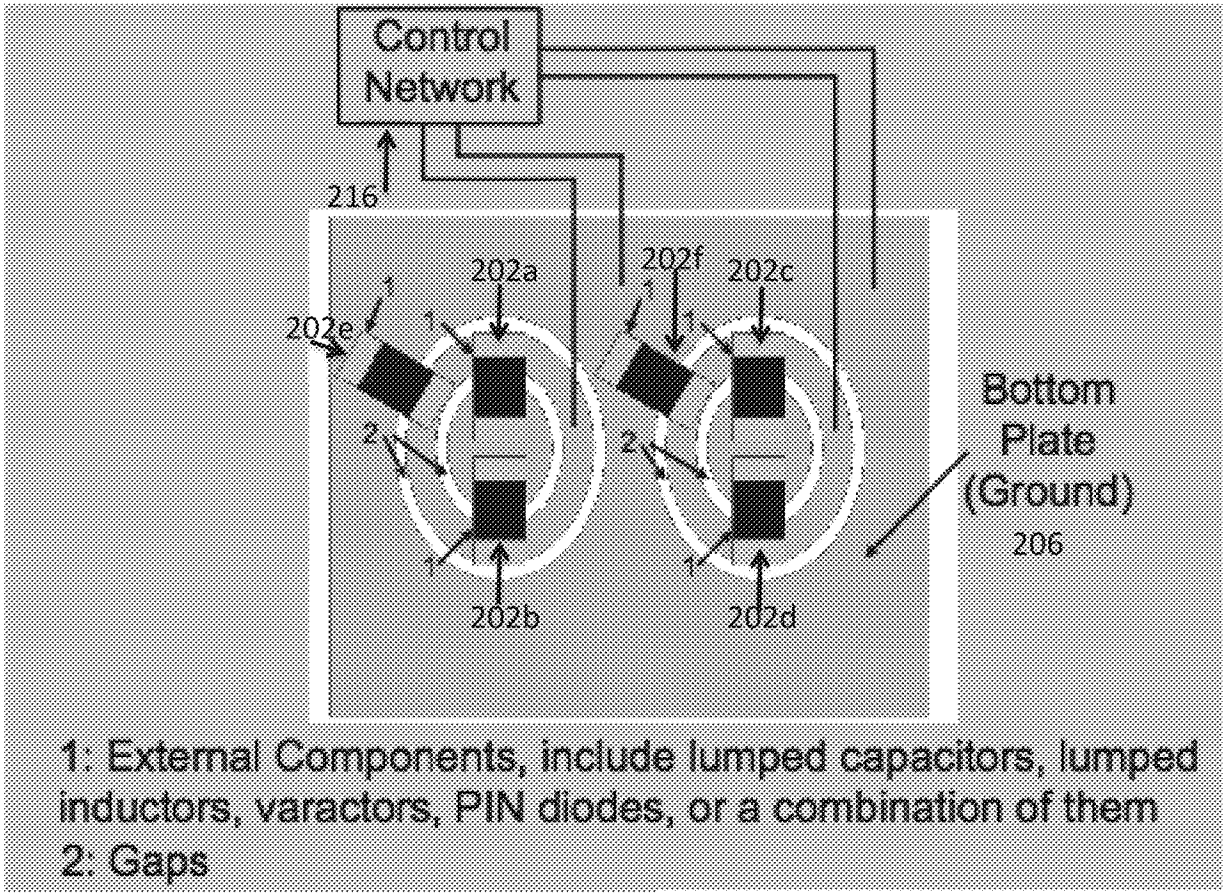
FIGS. 2*d* and 2*e* illustrate bottom views of tunable filters with three external components as tuning assemble.
Figure 2E:
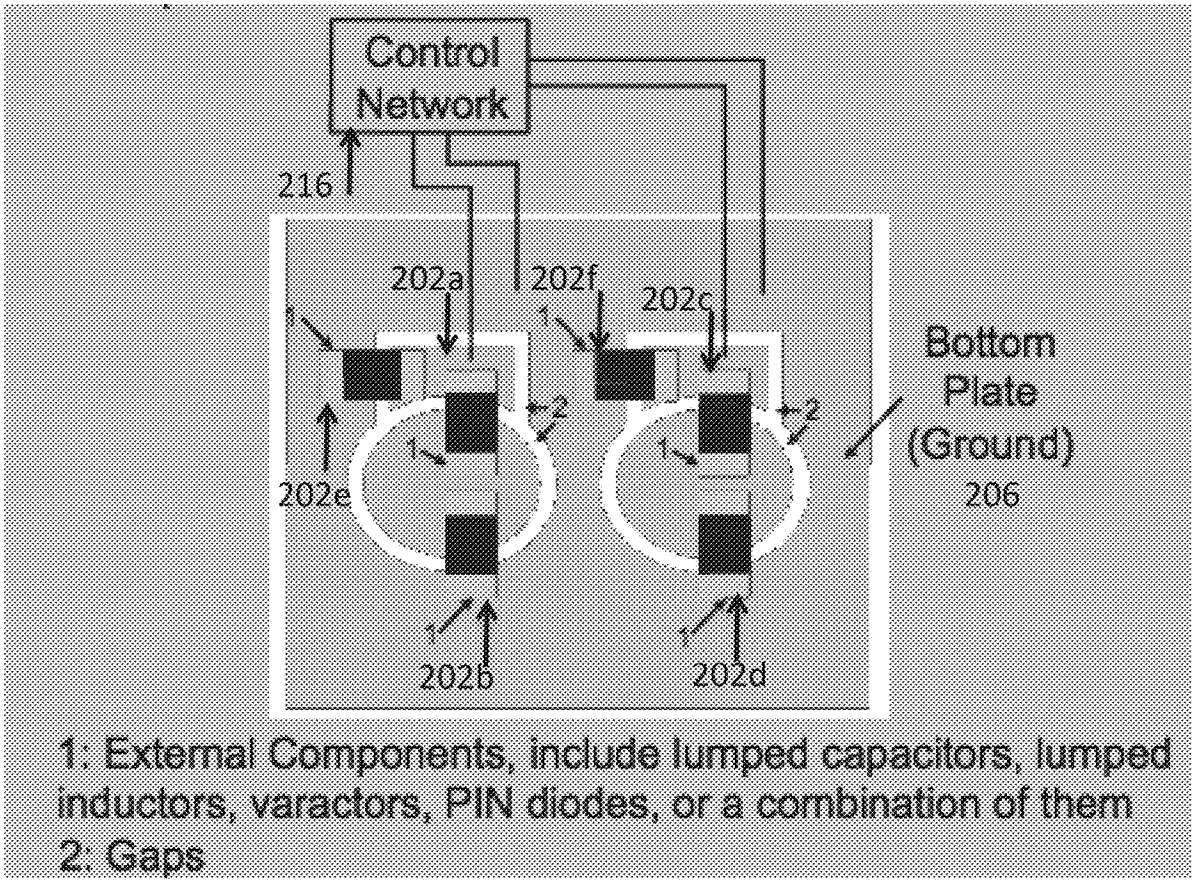

FIG. 2*b* illustrates a bottom view of the filter depicted in FIG. 2*a*. FIG. 2*c* illustrates a top view of the filter depicted in FIG. 2*a*. FIGS. 2*d* and 2*e* illustrate bottom view of tunable filters with three external components as tuning assemble.

According to one embodiment of the present disclosure, the tunable filter 200 includes a substrate 202, a top metal layer 204 and a bottom metal layer 206. Posts 208 serve as the periodic lattice structure in the substrate 202 and the top 204 and bottom layers 206. The filter 200 further includes externally attached elements 202*a-d*. The posts 208 go through the substrate 202 and connect the bottom layer 206 with the top layer 204. Controllably capacitive or inductive coupling is introduced by externally attached elements 2*a-d*. The filter 200 further includes an input 212 and an output 214.

Externally attached elements 202*a-f*, which are disposed in the housing, can be capacitors, inductors, PIN diodes, varactors, or various combinations thereof. The assembly of the external elements can include i) a discrete component such as a lumped capacitor, a lumped inductor or ii) various combinations of two or more of these discrete components (for a tunable filter operating at a specific frequency band applications). FIG. 2*b* illustrates the case in which each assembly of external elements includes two discrete components 202*a*-202*c* and 202*b*-202*d* and a control biasing network 216 used to bias a varactor or a PIN diode for changing its capacitance value. FIGS. 2*d* and 2*e* illustrate the case in which each assembly of external elements includes three discrete components 202*a*-202*b*-202*e* and 202*c*-202*d*-202*f* and a control biasing network 216 used to bias a varactor or a PIN diode for changing its capacitance value.

Figure 3:
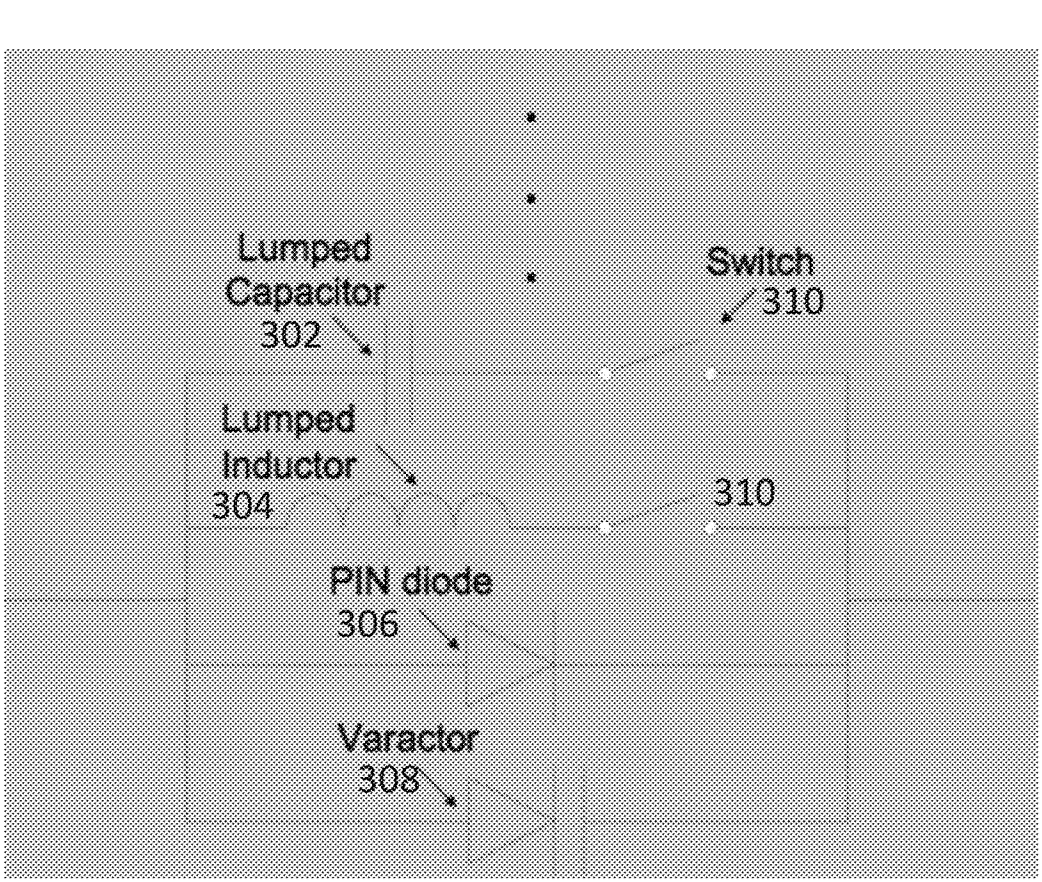
FIG. 3 is a schematic of an exemplary tuning assemble circuit comprising a combination of multiple components including lumped capacitors, lumped inductors, built in capacitors, PIN diodes, varactors, switches that can be formed as a tuning and frequency reconfigurable assemble.

FIG. 3 is a schematic of an exemplary tuning assemble circuit 300 comprising a combination of multiple components including lumped capacitors, lumped inductors, built in capacitors, PIN diodes, varactors, and switches that can be formed as a tuning and frequency reconfigurable assemble. As shown in FIG. 3, the external attached elements or an exemplary tuning assemble circuit 300 can include additional switches 310 with lumped capacitors 302, lumped inductors 304, PIN diodes 306 and varactors 308 to form various combinations thereof. These tuning assemblies are designed for a tunable filter operating at a specific frequency band, reconfigurable multi-frequency bands, and tunable filter applications.

According to another embodiment of the present disclosure, a controllable cavity resonator/filter includes an energy input and output coupling structure, a cavity structure and a controllable reactance structure. A substrate, metal layers above and below the substrate and an array of posts between metal layers make up the cavity structure. CPW and slotline structures are designed on a top metal layer of the cavity to enable input and output energy coupling. The controllable reactance structure is made up of external elements and interface with structure of the cavity. Alternatively, the reactance structure is made up of built in elements. For the external elements, the interface structure is designed on the housing of the cavity and made up of metal pad separated from surrounding metal by gaps. At least one of posts of cavity connects with the metal pad. A post impedance is determined by the connected post. The external elements which define a reactance are connected to the metal pad. Either the external or built in elements can be configured to controllably change the reactance between a first reactance and a second reactance. Working frequency of the cavity filter is based on the reactance and the post impedance (see, e.g., FIGS. 1*a-d*, 2*a-e*, and 3).

According to yet another embodiment of the present disclosure, a controllable cavity resonator/filter includes a substrate, metal layers above and below the substrate, an array of posts, a cap structure, and capacitive or inductive control elements. The cap structure includes a first portion spaced apart from a second portion by a gap space. The post structure extends between the substrate and the first portion of the cap structure. The capacitive or inductive control elements can be lumped elements, built in elements and can also include a plurality of tuning elements at least partially located in the gap space (see, e.g., FIGS. 1*a-d*, 2*a-e*, and 3).

EBG Dual-Band Bandpass Filter

According to another embodiment of the present invention, an EBG based dual-band filter includes a combination of two single band filters with one set of external capacitors. The dual-band EBG filter is implemented with a standard two layer metal PCB technology. The two single band filters are designed according to the designs presented above in FIGS. 1*a-d*, 2*a-e*, and 3. The EBG based dual-band filter achieves targeted performance while alleviating constraints imposed by working frequency selection, band to band isolation, and size issues. By sharing a common EBG substrate between the two filters, each filter has a better energy storage (i.e., a higher Qu) than it would have with a half size of substrate. In addition, the use of two sets of external capacitors does not derail the design of EBG substrate for an individual filter. The specific working frequency of each band of the filter can be selected on demand by adjusting the value of corresponding capacitors, which determine the resonance frequency. Such a design of dual-band filter has a size smaller than twice that of a single band filter and can work at multiple frequency bands without compromising individual band performance.

A controllable multiband resonator/filter includes an energy input and output coupling structure, controllable reactance structures, and an optimal EBG substrate. The resonator frame 400 of an optimal EBG substrate is depicted in FIGS. 4*a-b*.

Figure 4A:
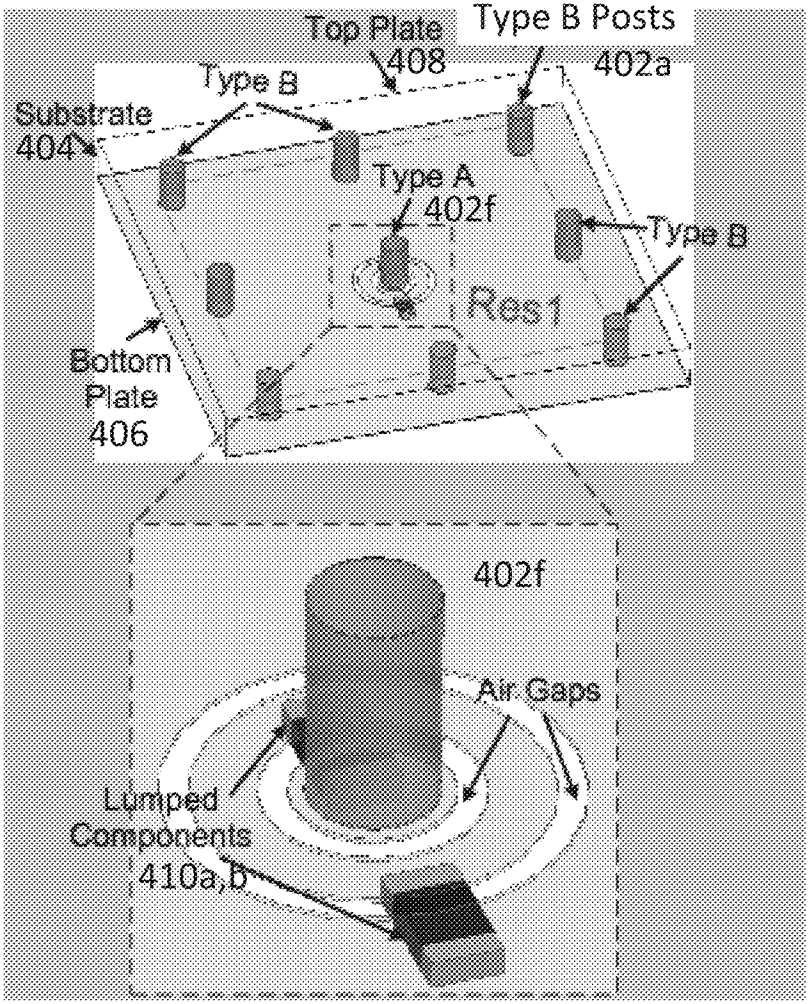
FIG. 4*a* illustrates a 3-dimensional schematic of an exemplary resonator frame according to one embodiment of the present invention.
Figure 4B:
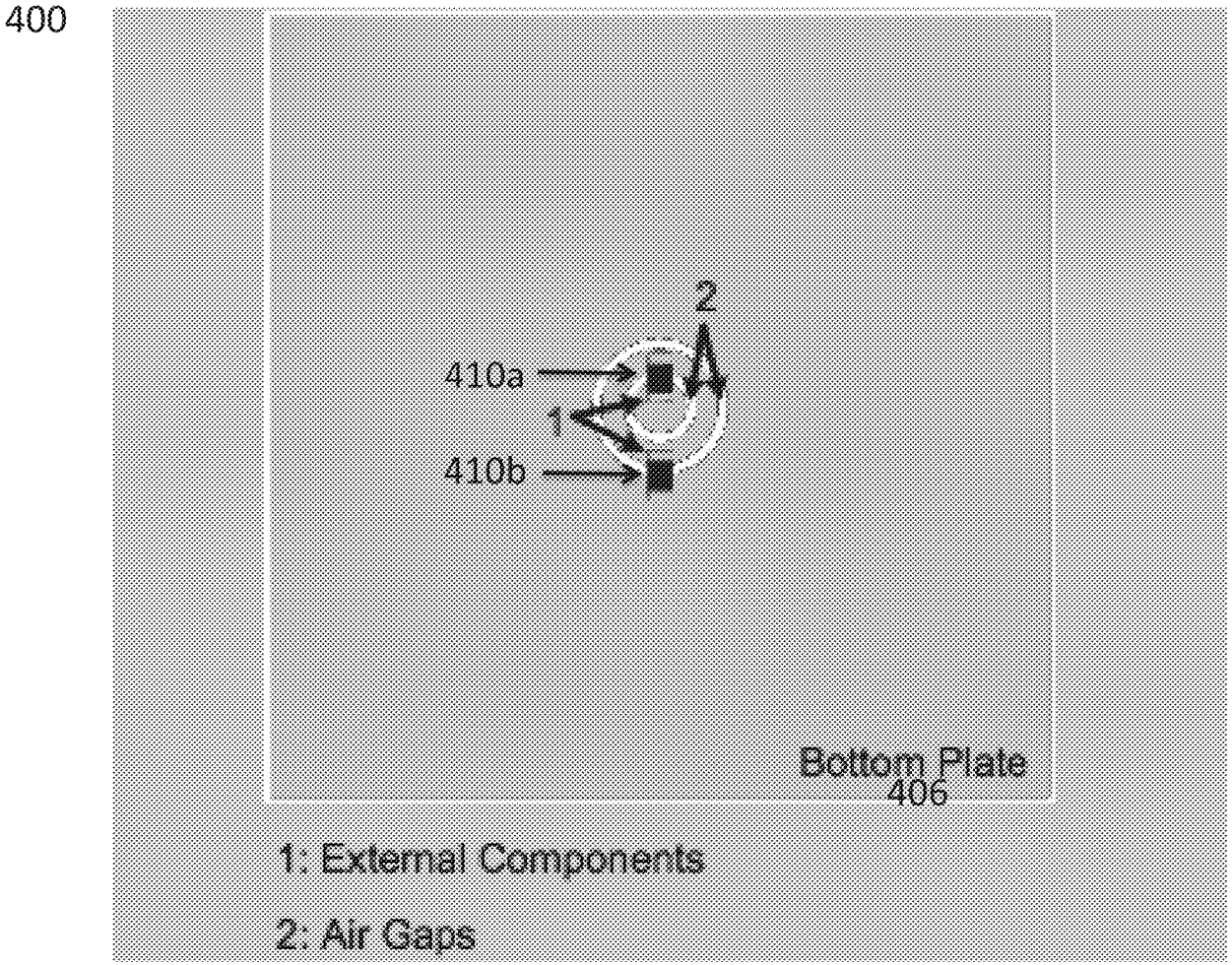
FIG. 4*b* illustrates a bottom view of the resonator frame depicted in FIG. 4*a*.

FIG. 4*a* illustrates a 3-dimensional schematic of an exemplary resonator frame 400 according to one embodiment of the present invention. FIG. 4*b* illustrates a bottom view of the resonator frame 400 depicted in FIG. 4*a*.

According to one embodiment, the resonator frame 400 includes substrate 404, posts 402, a top metal layer 408, and a bottom metal layer 406. A reactance structure comprising lumped components 410*a* and 410*b* is connected with the resonator frame 400. The working frequency of the resonator 400 is determined by the reactance value of the lumped components 410*a* and 410*b*. It will be appreciated that posts 402*a-f* are denoted in FIG. 4*a* as being either "type A" or "type B." A type A post is connected with a reactance structure, and a type B post is not.

Figure 5:
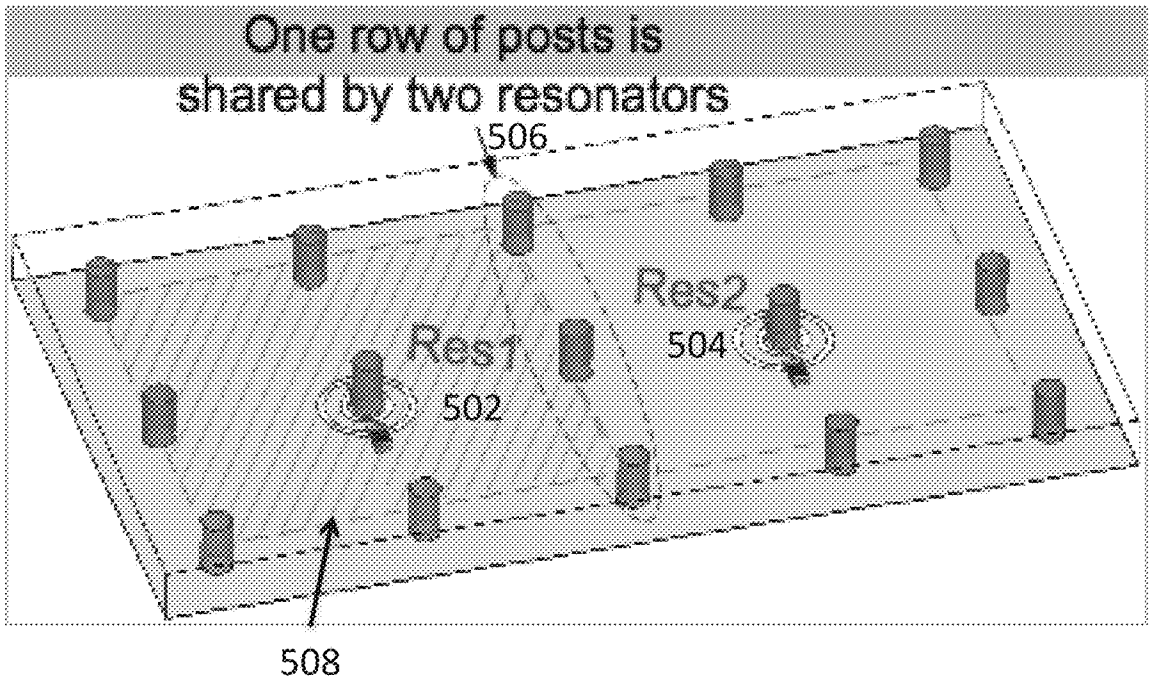
FIG. 5 illustrates an exemplary single-band filter frame comprising two adjacent resonator frames, according to one embodiment of the present invention.

FIG. 5 illustrates an exemplary single-band filter frame 500 comprising two adjacent resonator frames, according to one embodiment of the present invention. The single-band filter frame 500 includes two resonator frames 502 and 504 placed next to each other. The first and second resonators 502 and 504 share one row of posts 506. In this embodiment, the reactance structures of the resonators 502 and 504 are designed to have the same reactance value. The two resonators 502 and 504 contribute to a two-pole frequency performance at one working band of the filter 500. The cross-hatched shadowed portion 508 of the frame 500 is the effective substrate of the first resonator 502 used for magnetic storage. As the area of the shadowed portion 508 increases, so does the amount of magnetic energy stored by the first resonator 502.

Figure 6:
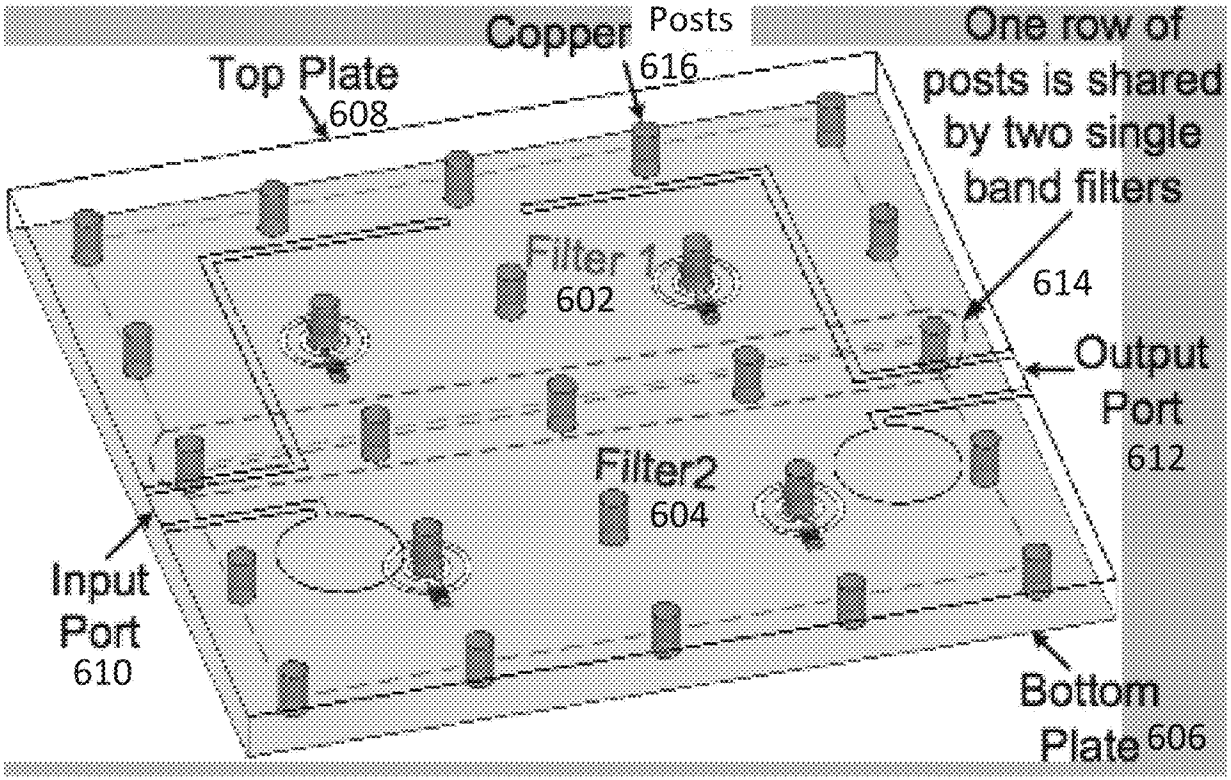
FIG. 6 illustrates an exemplary dual band filter with two single band filter frames, according to one embodiment of the present invention.

FIG. 6 illustrates an exemplary dual band filter 200 with two single band filter frames, according to one embodiment of the present invention. The dual band filter 600 includes two single band filters 602 and 604 placed next to each other. The filter 600 includes a top metal layer 608, a bottom metal layer 606, an input port 610, and output port 612, and posts 616. The two filters 602 and 604 share a row 614 of posts 616. The dual band filter 600 is capable of working at two customizable selected frequency bands, achievable by selecting corresponding reactance values.

Figure 7:
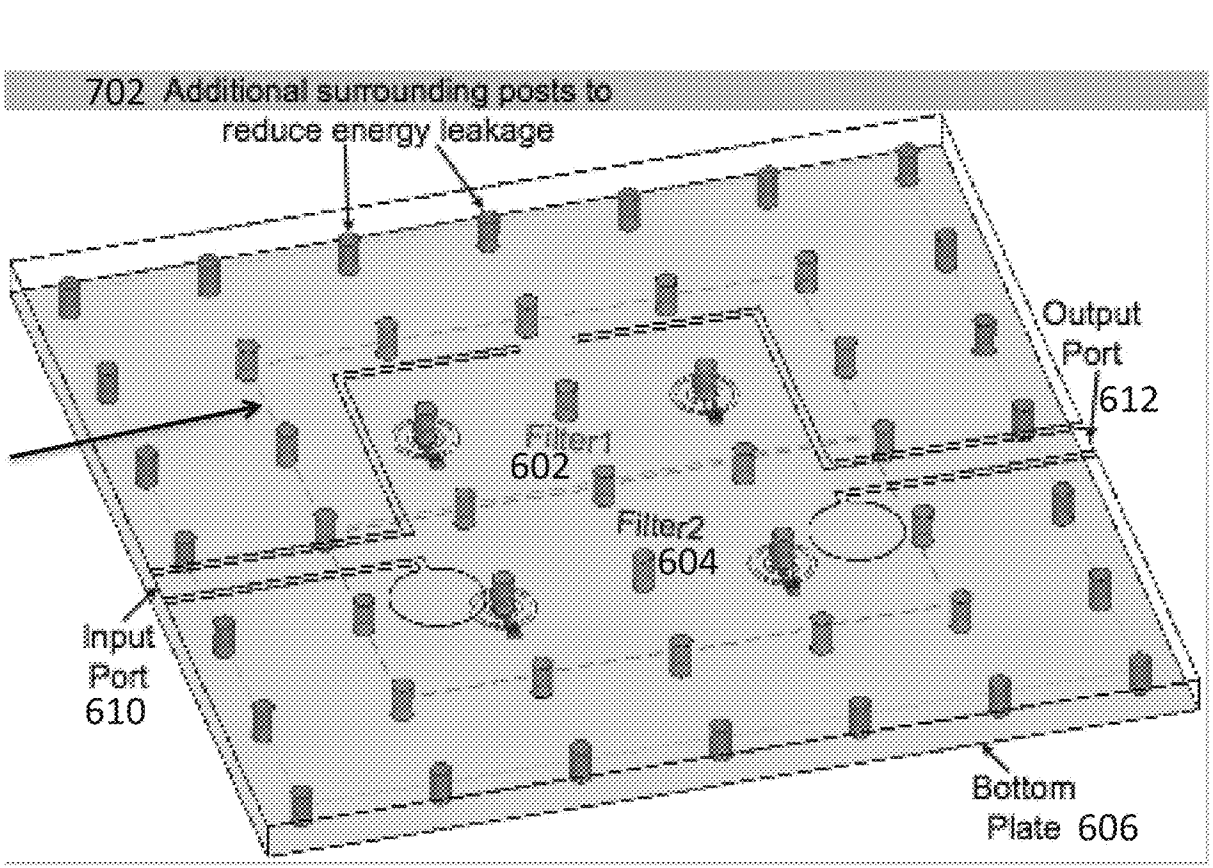
FIG. 7 illustrates an exemplary dual band filter with reduced energy leakage, according to one embodiment of the present invention.

FIG. 7 illustrates an exemplary dual band filter 700 with reduced energy leakage, according to one embodiment of the present invention. The exemplary dual band filter 700 has reduced energy leakage due to the addition of more surrounding posts 702. The filter 700 includes two adjacent filters 602 and 604, a bottom plate 606, an input port 610, an output port 612, and a top metal layer. The dashed line in FIG. 7 illustrates that the filter 700 is filter 600 with the addition of outer posts 702 surrounding filter 600.

Figure 8:
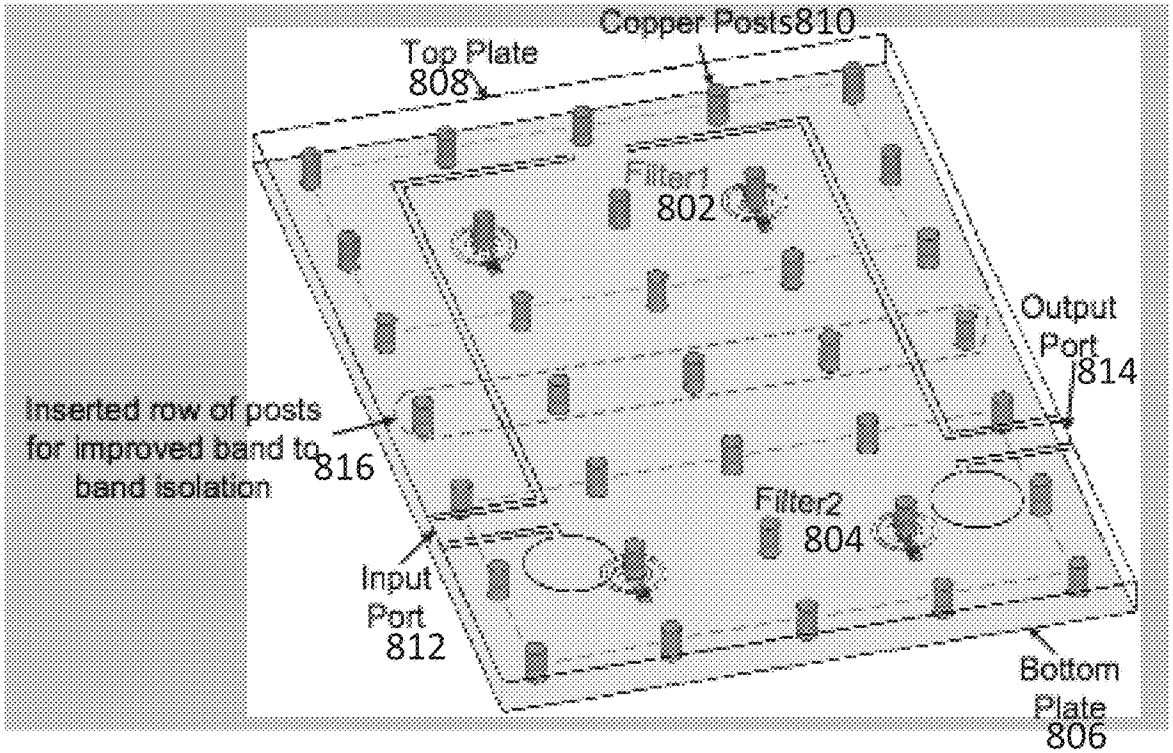
FIG. 8 illustrates an exemplary dual band filter with improved band to band isolation, according to one embodiment of the present invention.

FIG. 8 illustrates an exemplary dual band filter 800 with improved band to band isolation, according to one embodiment of the present invention. The exemplary dual band filter 800 includes two adjacent filters 802 and 804, with a bottom metal layer 806, top metal layer 808, posts 810, and input 812 and output ports 814. An additional row of posts 816 is inserted between the single band filter frames 802 and 804 for improved band to band isolation. It will be appreciated that additional rows of posts can be added into the design for more enhanced isolation.

Figure 9:
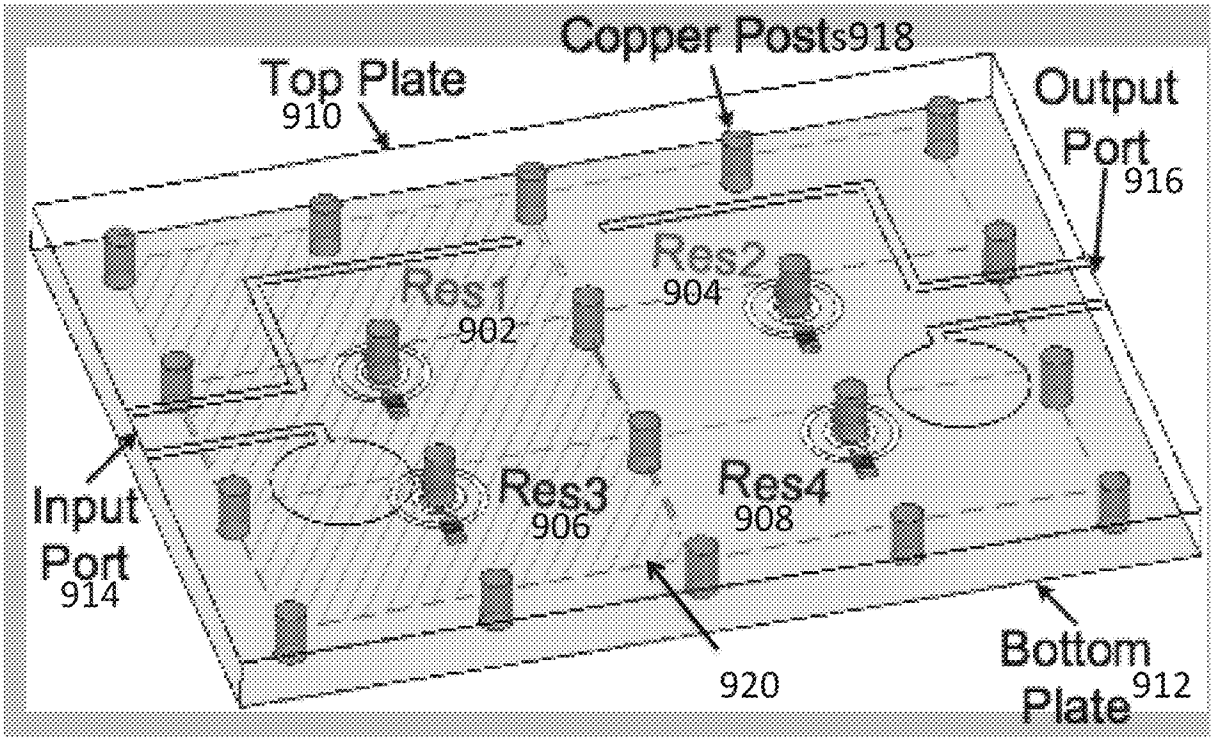
FIG. 9 illustrates an exemplary dual band filter with combined single band filter frames, according to one embodiment of the present invention.

FIG. 9 illustrates an exemplary dual band filter 900 with combined single band filter frames, according to one embodiment of the present invention. The filter 900 includes a bottom metal layer 912, a top metal layer 910, posts 918, an input port 914 and an output port 916. The filter includes first, second, third and fourth resonators 902, 904, 906, and 908. The first and second resonators 902 and 904 are resonators of a two-pole single band filter and contribute to one working frequency band. The third and fourth resonators 906 and 908 contribute to the other working frequency band. The second and fourth resonators 904 and 908 are combined together for reduced size of the entire filter 900 and improved energy storage capability of each resonator. The first and third resonators 902 and 906 are also combined. The shadowed portion 920 in FIG. 9 illustrates the effective substrate of the combination of the first and third resonators 902 and 906 for magnetic energy storage. The filter 900 has optimized insertion loss (IL) and Qu (unloaded quality factor) with respect to its size. The filter 900 has an even more compact size in this shared frame design, and the filter's 900 performance is improved over its standalone individual single band filters due to increased energy storage capability.

Figure 10:
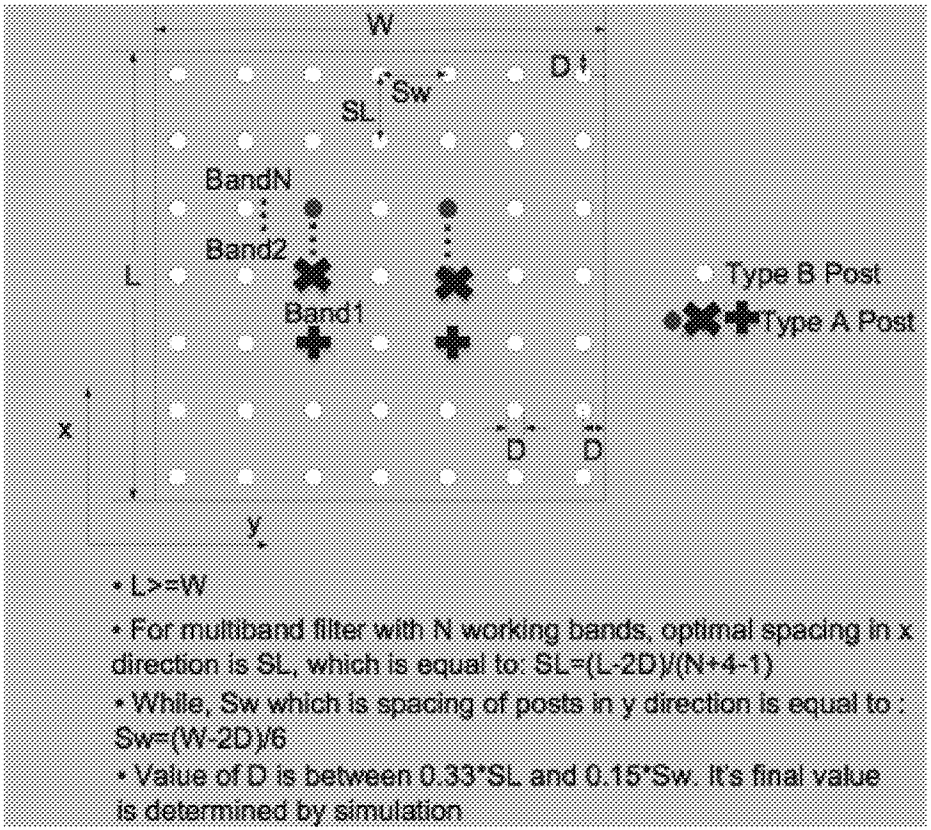
FIG. 10 illustrates an exemplary optimal EBG structure design for a multiband filter, according to one embodiment.

FIG. 10 illustrates a design of an exemplary optimal EBG structure 1000 for a multiband filter, according to one embodiment. The optimal EBG structure 1000 is used for a multiband filter with customizable selected number of working frequency bands. N represents the number of the filter's working frequency bands. Two type A posts are used for coupling two resonators to form a single band filter. In FIG. 10, L (length of substrate) is greater than or equal to W (width of substrate). The optimal spacing in the x direction shown in FIG. 10 is SL, and SL=(L−2D)/(N+4−1). The optimal spacing in the y direction is SW, and SW=(W−2D)/6. The value of D is between 0.33*SL and 0.15*SW (final value is determined by simulation).

Figure 11A:
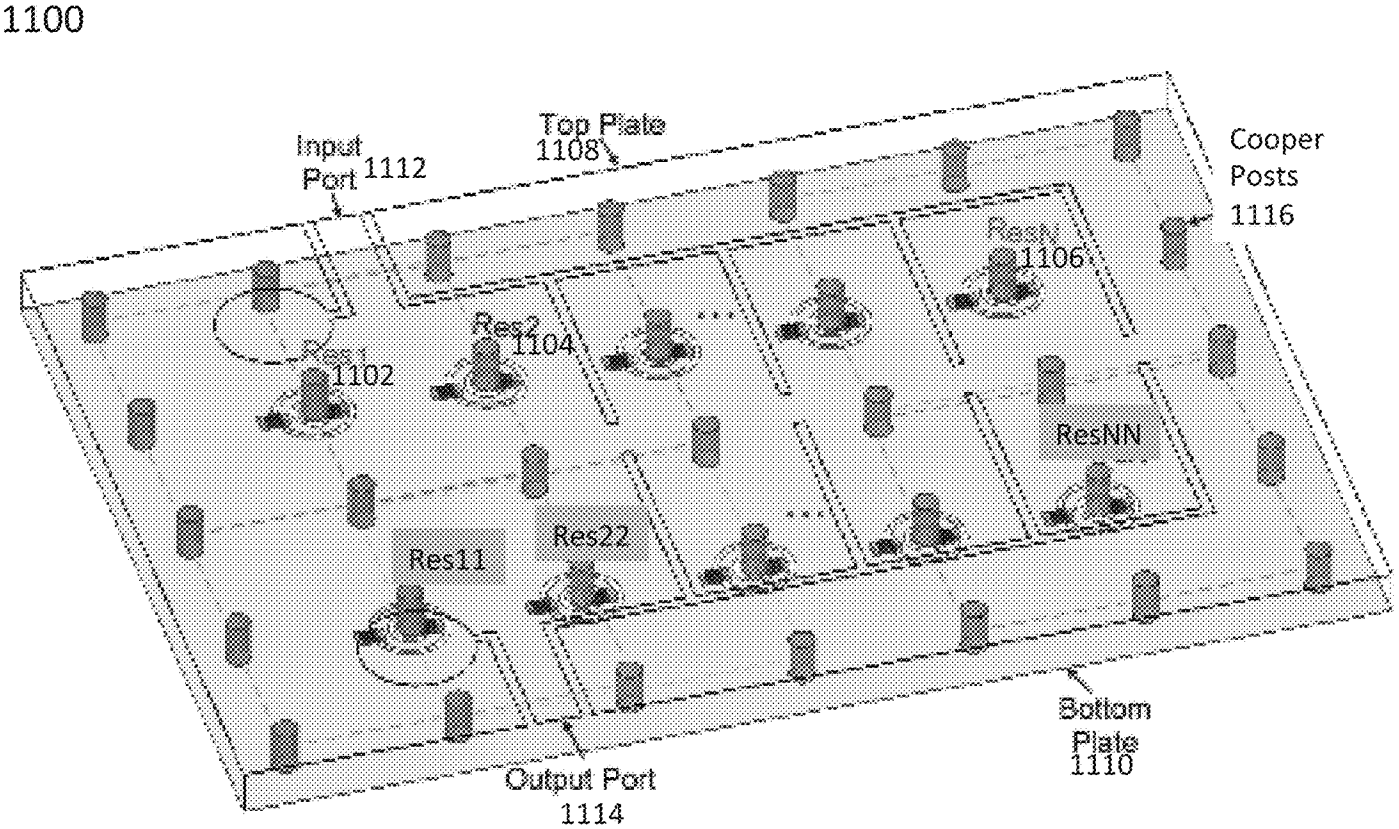
FIG. 11*a* illustrates a 3-dimensional schematic of an N-band filter with combined single band filter frames, according to one embodiment.
Figure 11B:
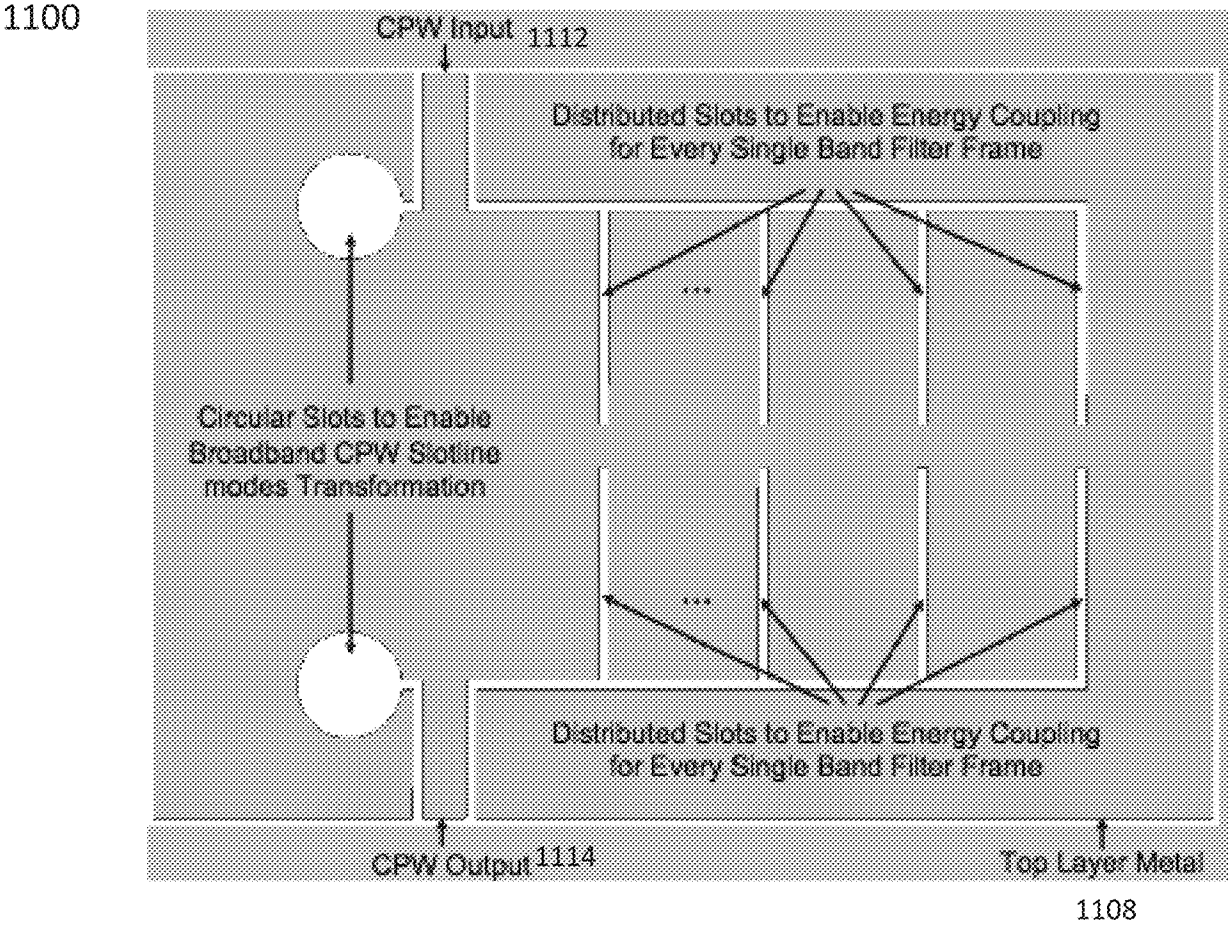
FIG. 11*b* illustrates a top view of the filter depicted in FIG. 11*a*.
Figure 11C:
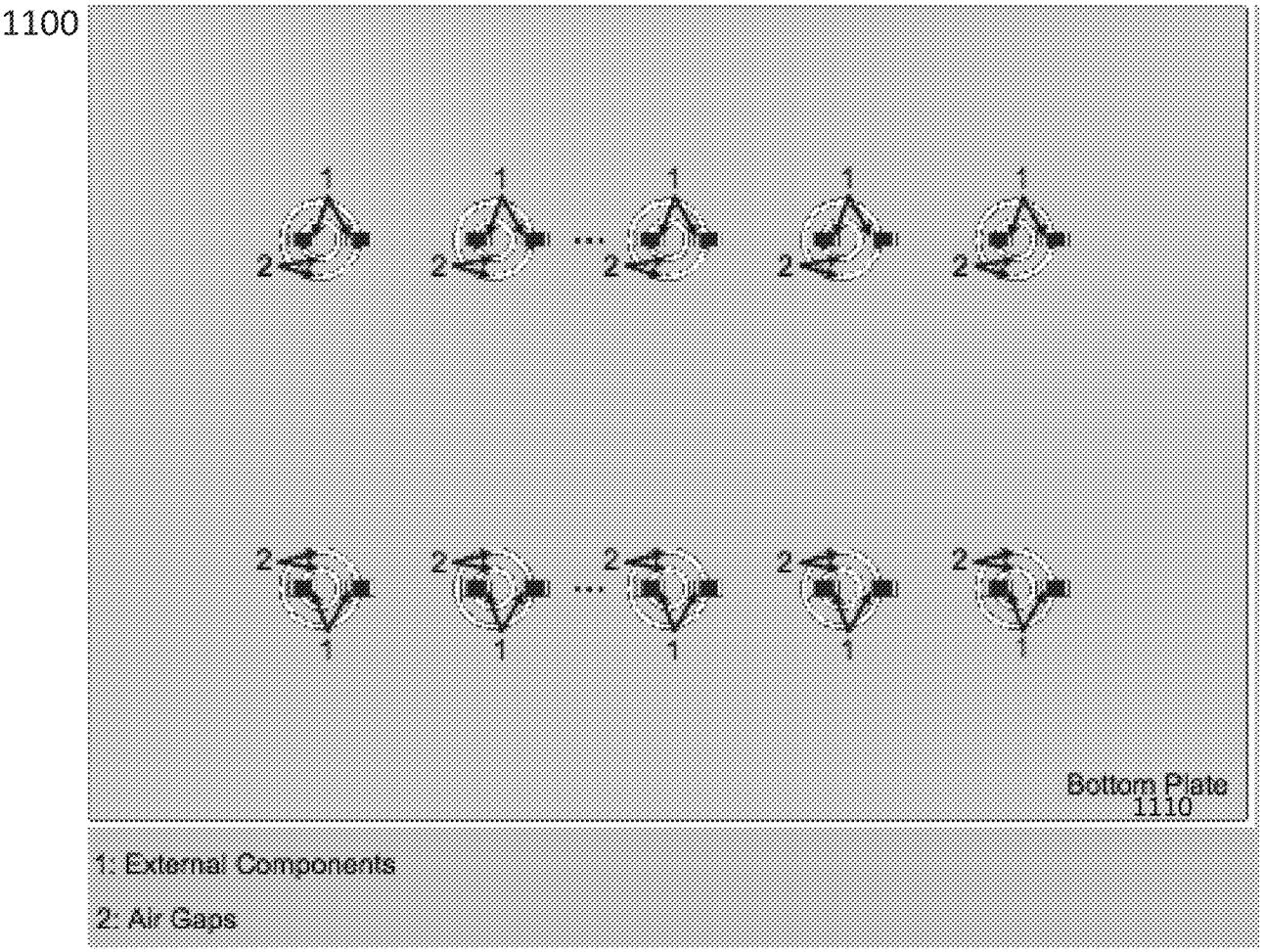
FIG. 11*c* illustrates a bottom view of the filter depicted in FIG. 11*a*.

FIG. 11*a* illustrates a 3-dimensional schematic of an N-band filter 1100 with combined single band filter frames, according to one embodiment. FIG. 11*b* illustrates a top view of the filter 1100 depicted in FIG. 11*a*. FIG. 11*c* illustrates a bottom view of the filter 1100 depicted in FIG. 11*a*.

The N-band filter 1100 has an EBG structure as depicted in FIG. 10. The filter 1100 includes a top metal layer 1108, a bottom metal layer 1110, posts 1116, an input port 1112 and an output port 1114. The substrate of the N-band filter 1100 is made up of single band filter frames, including a first resonator 1102, a second resonator 1104, . . . to an Nth resonator 1106. By specifically determining reactance values, the filter 1100 is capable of working at N frequency bands with customizable selected center frequency and good band to band isolation. Input and output energy transition and coupling structures of the N-band filter 1100 are made up of CPW, circular open slot and distributed slot lines. Circular open slots are used to enable a broadband energy transition from CPW mode to slotline mode. Signals in slotline mode are then coupled to the EBG frame by distributed slotlines, which enable an efficient energy coupling for every single band frame of the filter 1100. The energy transition and coupling structures can also be implemented by other types of microwave transmission lines like microstrip.

Figure 12:
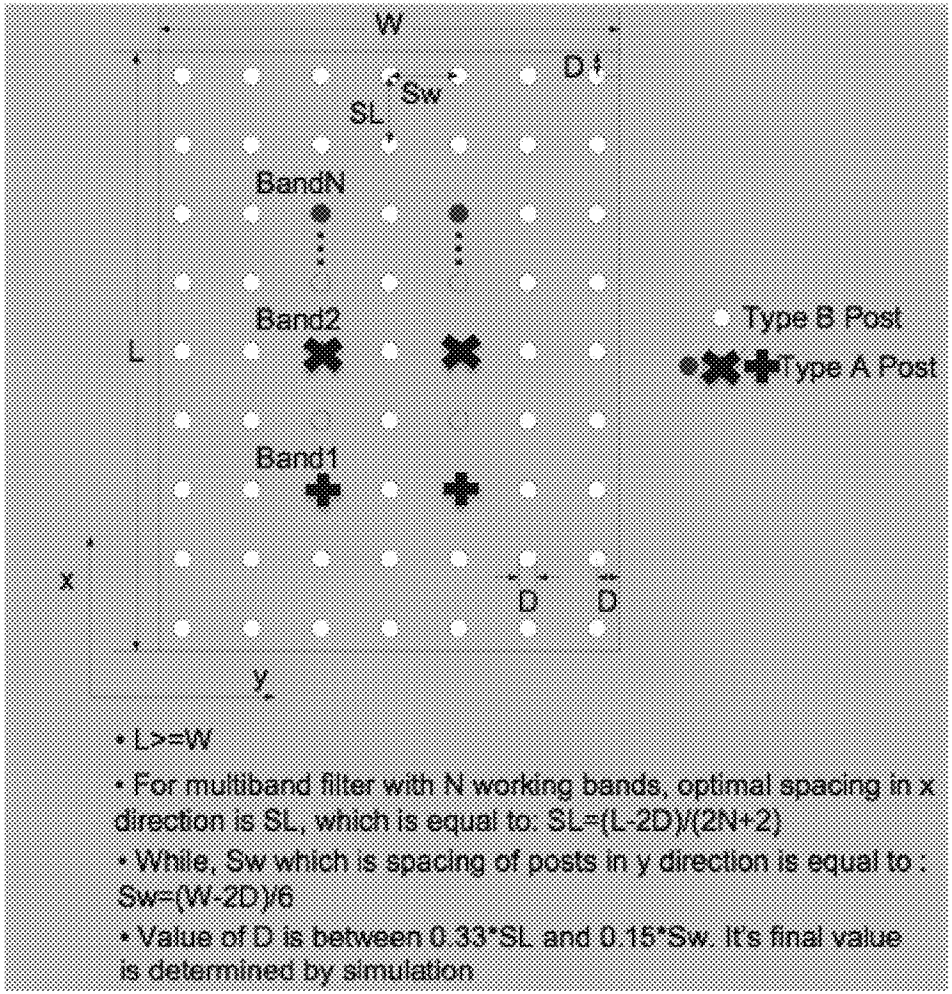
FIG. 12 illustrates an exemplary EBG structure for an N-band multiband filter with improved band to band isolation, according to one embodiment of the present invention.

FIG. 12 illustrates an exemplary EBG structure 1200 for an N-band multiband filter with improved band to band isolation, according to one embodiment of the present invention. The exemplary EBG structure 1200 includes single band filter frames placed next to each other, and a row of posts is shared by two single band filters. Two type A posts are used for coupling two resonators to form a single band filter. In FIG. 12, L (length of substrate) is greater than or equal to W (width of substrate). The optimal spacing in the x direction shown in FIG. 10 is SL, and SL=(L−2D)/(2N+2). The optimal spacing in the y direction is SW, and SW=(W−2D)/6. The value of D is between 0.33*SL and 0.15*SW (final value is determined by simulation).

Figure 13:
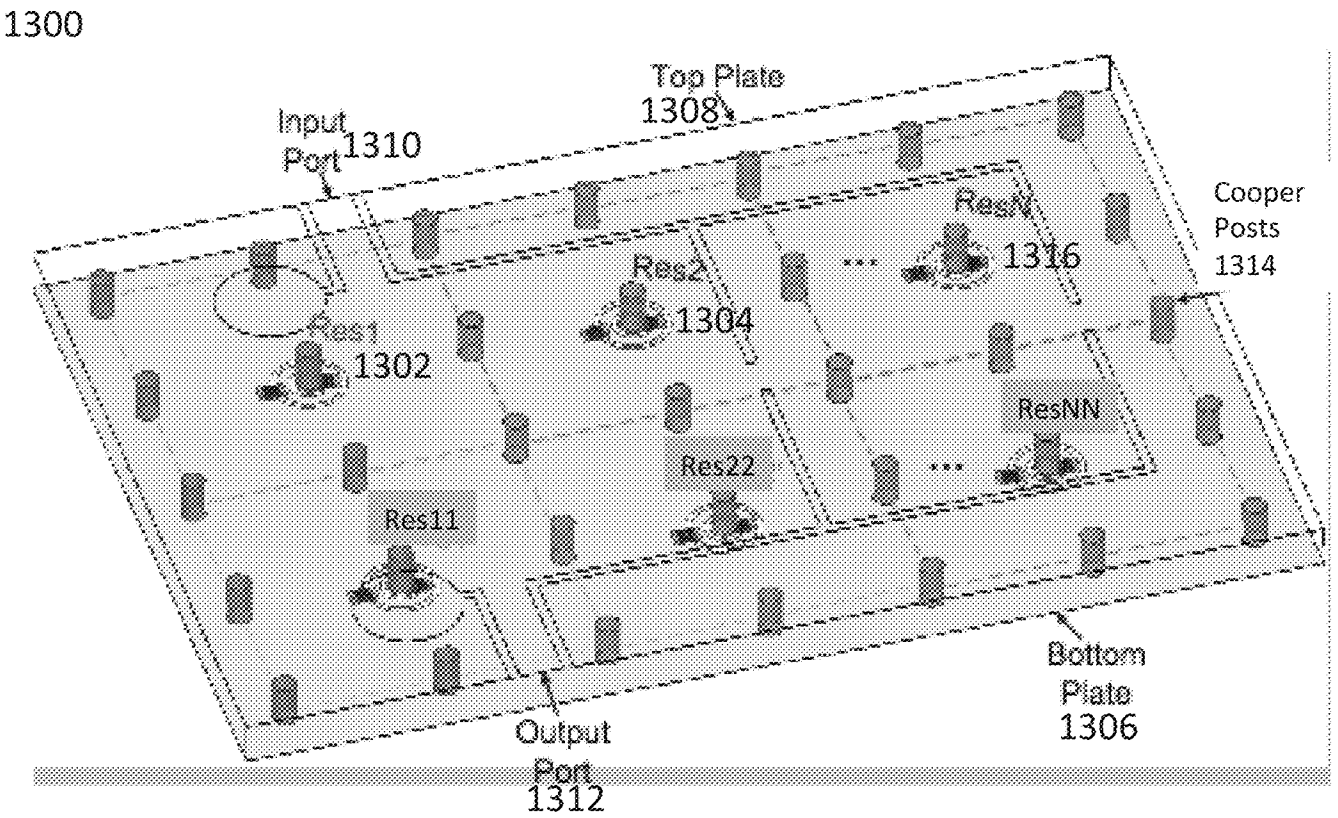
FIG. 13 illustrates an N-band filter with improved band to band isolation, according to one embodiment of the present invention.

FIG. 13 illustrates an N-band filter 1300 with improved band to band isolation, according to one embodiment of the present invention. The N-band filter 1300 with improved band to band isolation has an EBG structure as shown in FIG. 12. The N-band filter 1300 includes a top metal layer 1308, a bottom metal layer 1306, an input port 1310, an output port 1312, and posts 1314. The filter 1300 includes resonators a first resonator 1302, a second resonator 1304 . . . to an Nth resonator 1316.

Figure 14A:
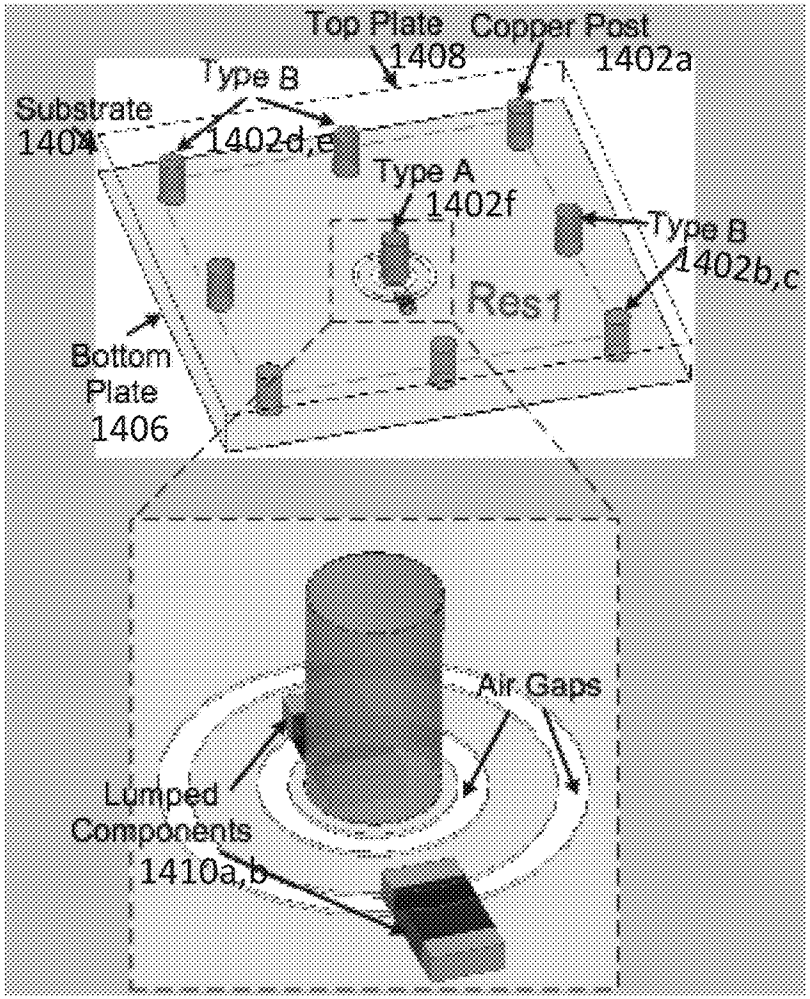
FIG. 14*a* illustrates a 3-dimensional schematic of a tunable resonator, according to one embodiment of the present invention.
Figure 14B:
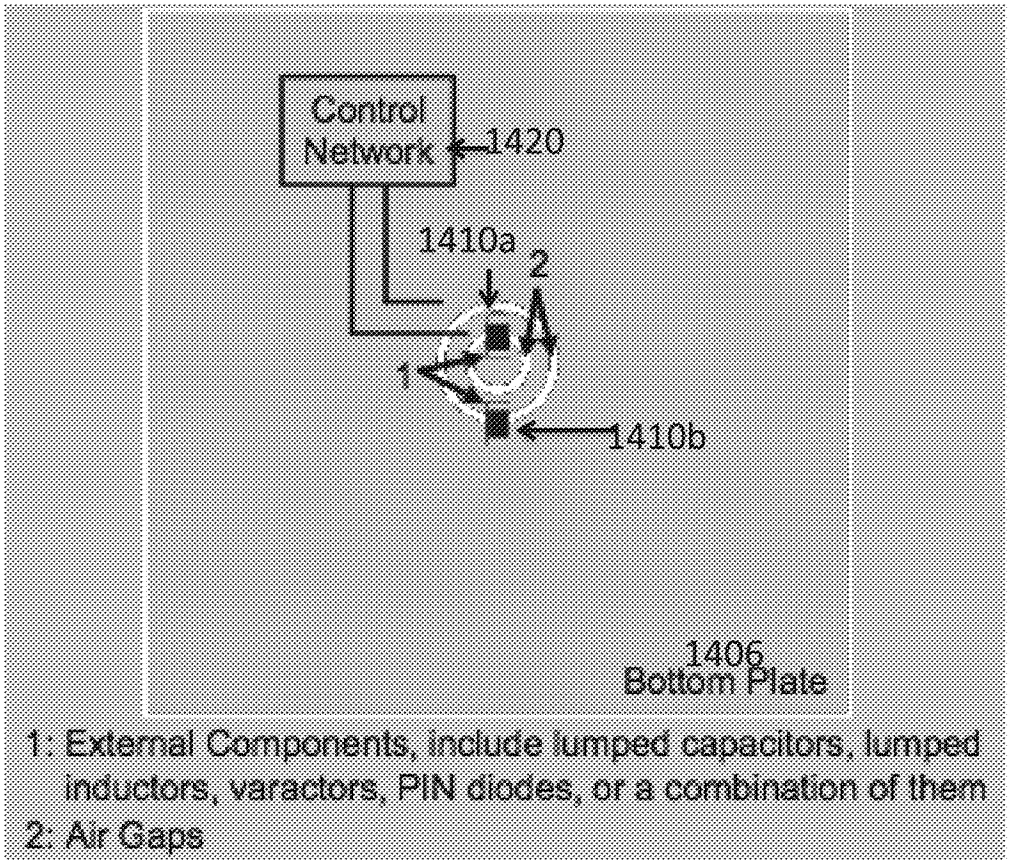
FIGS. 14*b* and 14*c* illustrate bottom views of the resonator depicted in FIG. 14*a*.
Figure 14C:
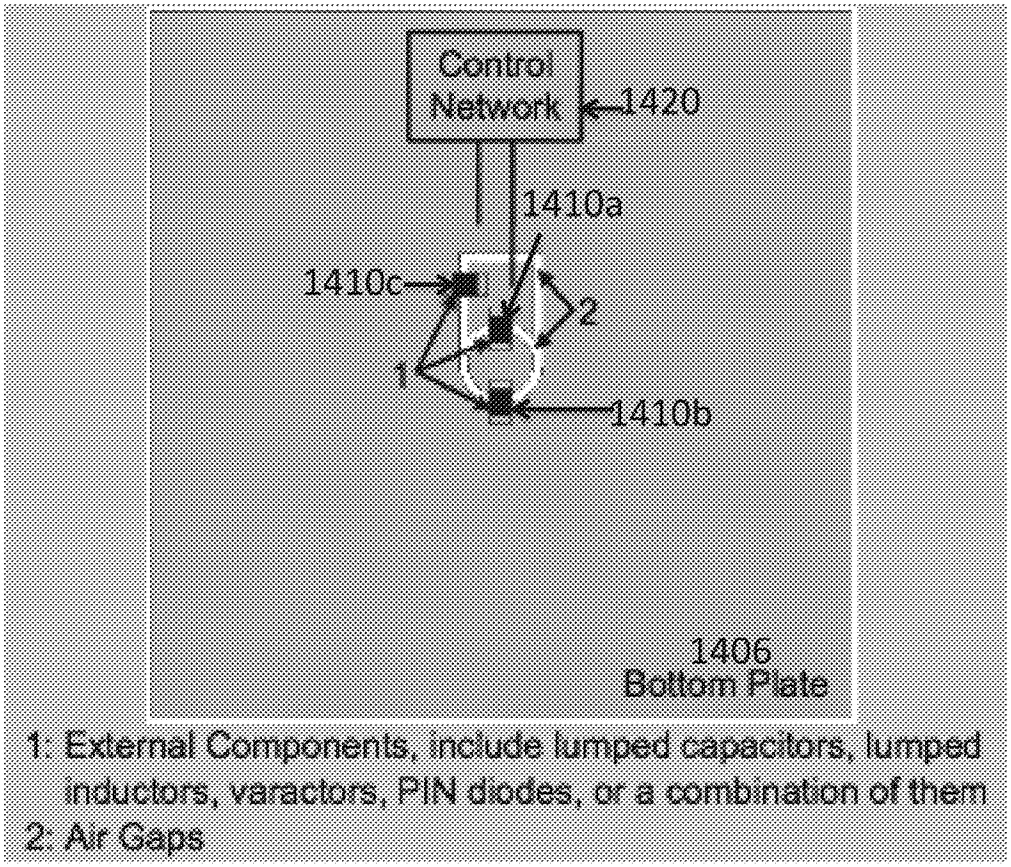

FIG. 14*a* illustrates a 3-dimensional schematic of a tunable resonator 1400, according to one embodiment of the present invention. FIGS. 14*b* and 14*c* illustrate bottom views of the resonator 1400 depicted in FIG. 14*a*.

By connecting controllable reactance components with a resonator frame, a tunable resonator 1400 is implemented as discussed above in FIG. 4*a*. Here, the tunable resonator frame 1400 includes posts 1402, a top metal layer 1408, and a bottom metal layer 1406. A reactance structure is connected with the resonator frame 1400, and the reactance structure is made of external lumped components 1410*a* and 1410*b*. The working frequency of the resonator 1400 is determined by the reactance value of the lumped components 1410*a* and 1410*b*. It will be appreciated that posts 1402*a-f* are denoted in FIG. 14*a* as being either "type A" or "type B." A type A post is connected with a reactance structure, and a type B post is not.

The external components (shown as lumped components 1410*a* and 1410*b*) can be a discrete component such as a lumped capacitor, a lumped inductor, or a various combination of two or more of the discrete components (for a tunable resonator operating at a specific frequency band). FIG. 14*b* illustrates two discrete components 1410*a*, 1410*b* and a control biasing network 1420 used to bias a varactor or PIN diode for changing its capacitance value. FIG. 14*c* illustrates three discrete components 1410*a*, 1410*b*, 1410*c* and a control biasing network 1420 used to bias a varactor or PIN diode for changing its capacitance value.

Figure 15A:
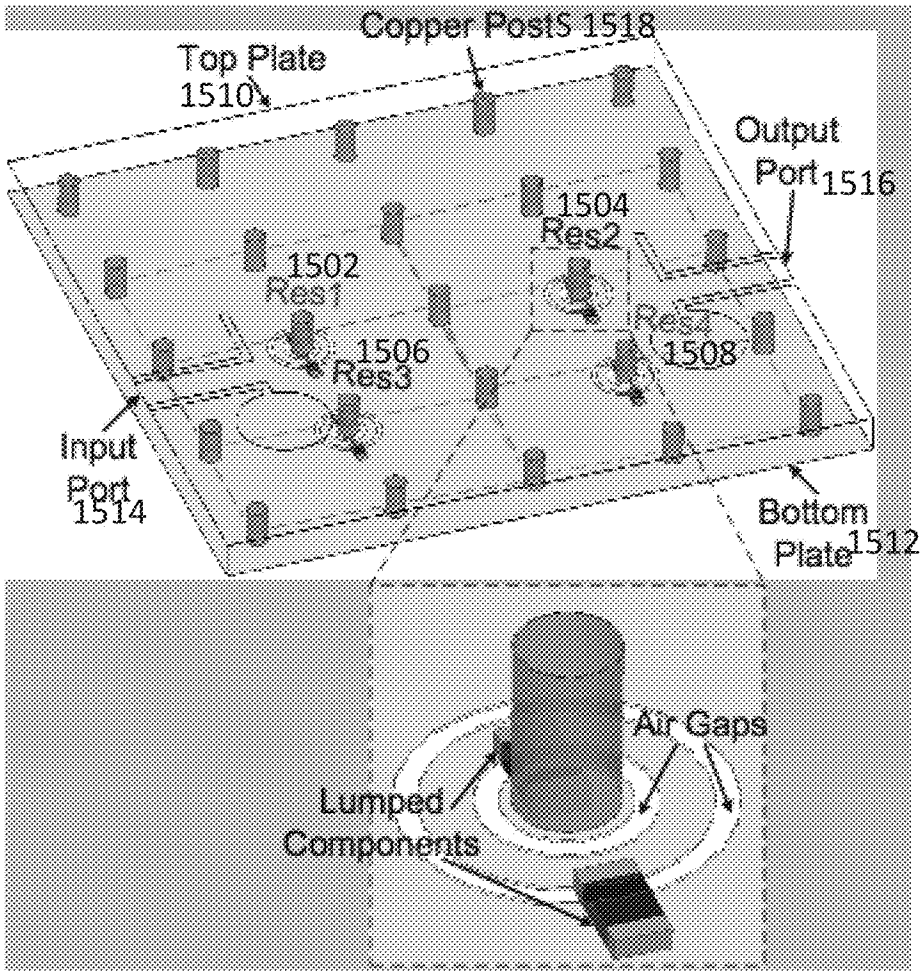
FIG. 15*a* illustrates a 3-dimensional schematic of an exemplary tunable dual-band filter, according to one embodiment of the present invention.
Figure 15B:
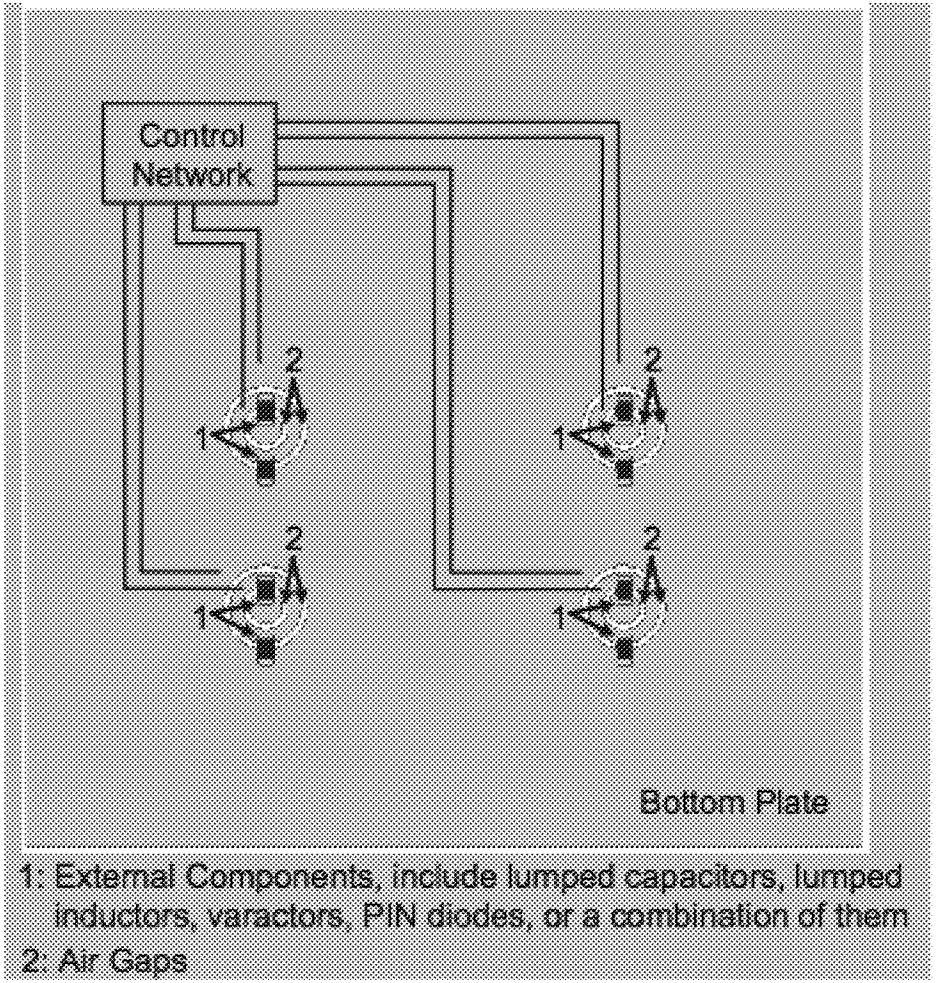
FIGS. 15*b* and 15*c* illustrate bottom views of the filter depicted in FIG. 15*a*.
Figure 15C:
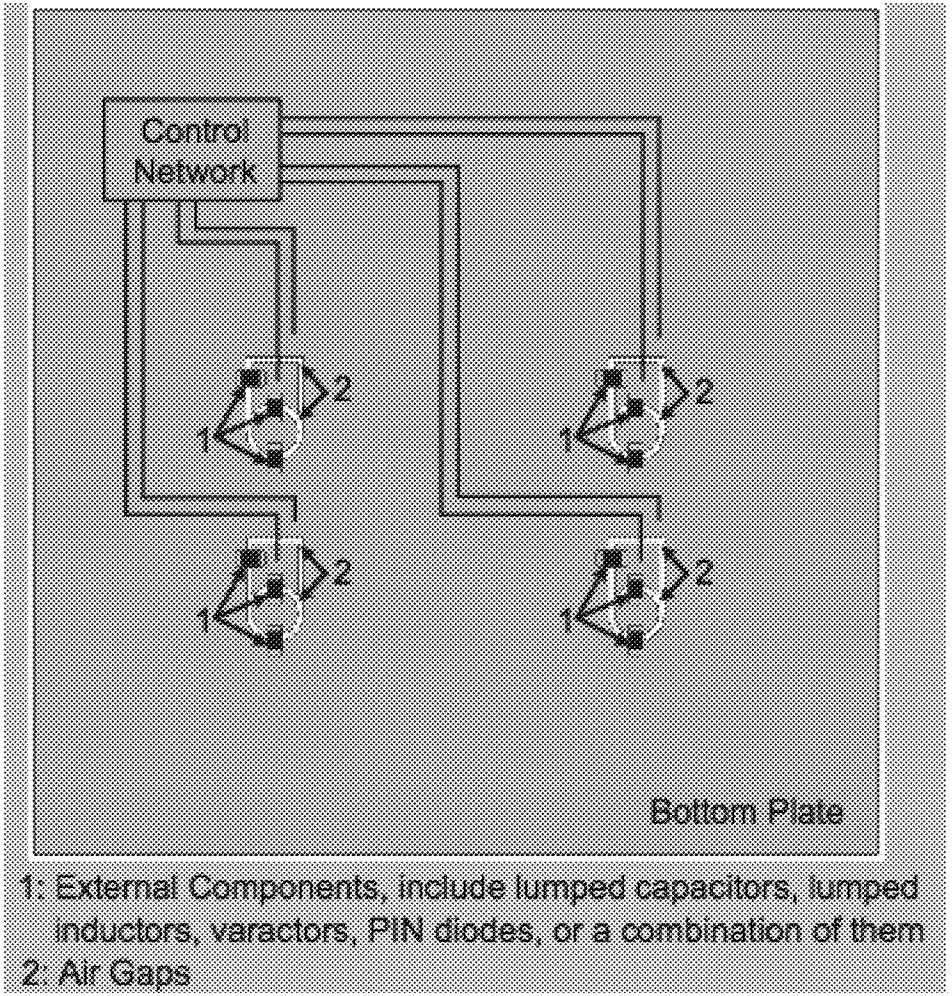

FIG. 15*a* illustrates a 3-dimensional schematic of an exemplary tunable dual-band filter 1500, according to one embodiment of the present invention. FIGS. 15*b* and 15*c* illustrate bottom views of the filter 1500 depicted in FIG. 15*a*.

The exemplary tunable dual-band filter 1500 is based on the tunable resonator depicted in FIGS. 14*a-c*. The filter 1500 includes a top metal layer 1510, a bottom metal layer 1512, an input port 1514, an output port 1516, posts 1518, and first, second, third and fourth resonator frames 1502, 1504, 1506, and 1508.

FIG. 15*b* illustrates a bottom view of a tunable dual-band filter 1500 with two external components as a tuning assemble. FIG. 15*c* illustrates a bottom view of a tunable dual-band filter 1500 with three external components as a tuning assemble. The external components can be a discrete component such as a lumped capacitor, a lumped inductor, or a various combination of two or more of the discrete components (for a tunable resonator operating at a specific frequency band). Each of FIGS. 15*b* and 15*c* illustrate a control biasing network used to bias a varactor or PIN diode for changing its capacitance value.

Figure 16A:
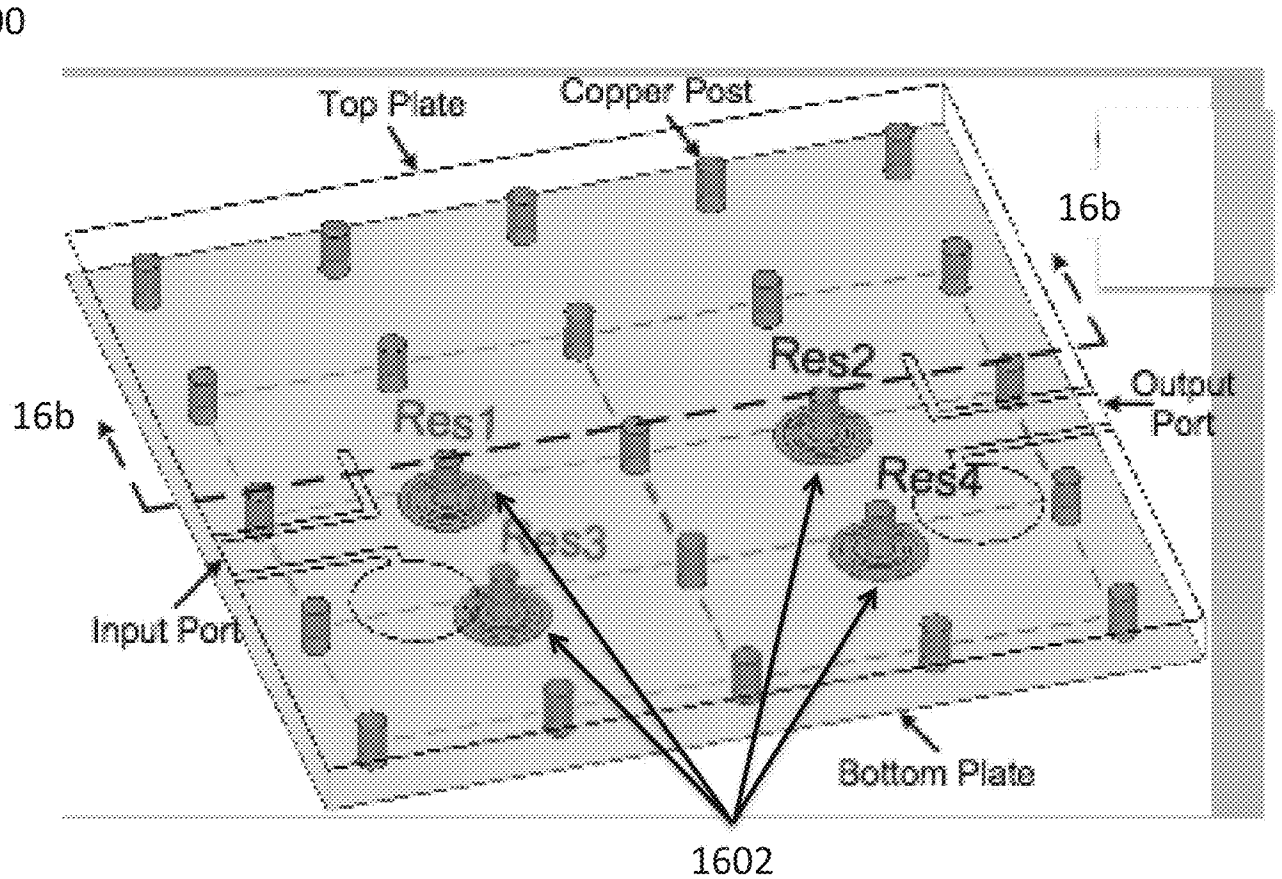
FIG. 16*a* illustrates a 3-dimensional schematic of a filter with built in capacitors directly on an EBG substrate, according to one embodiment of the present invention.
Figure 16B:
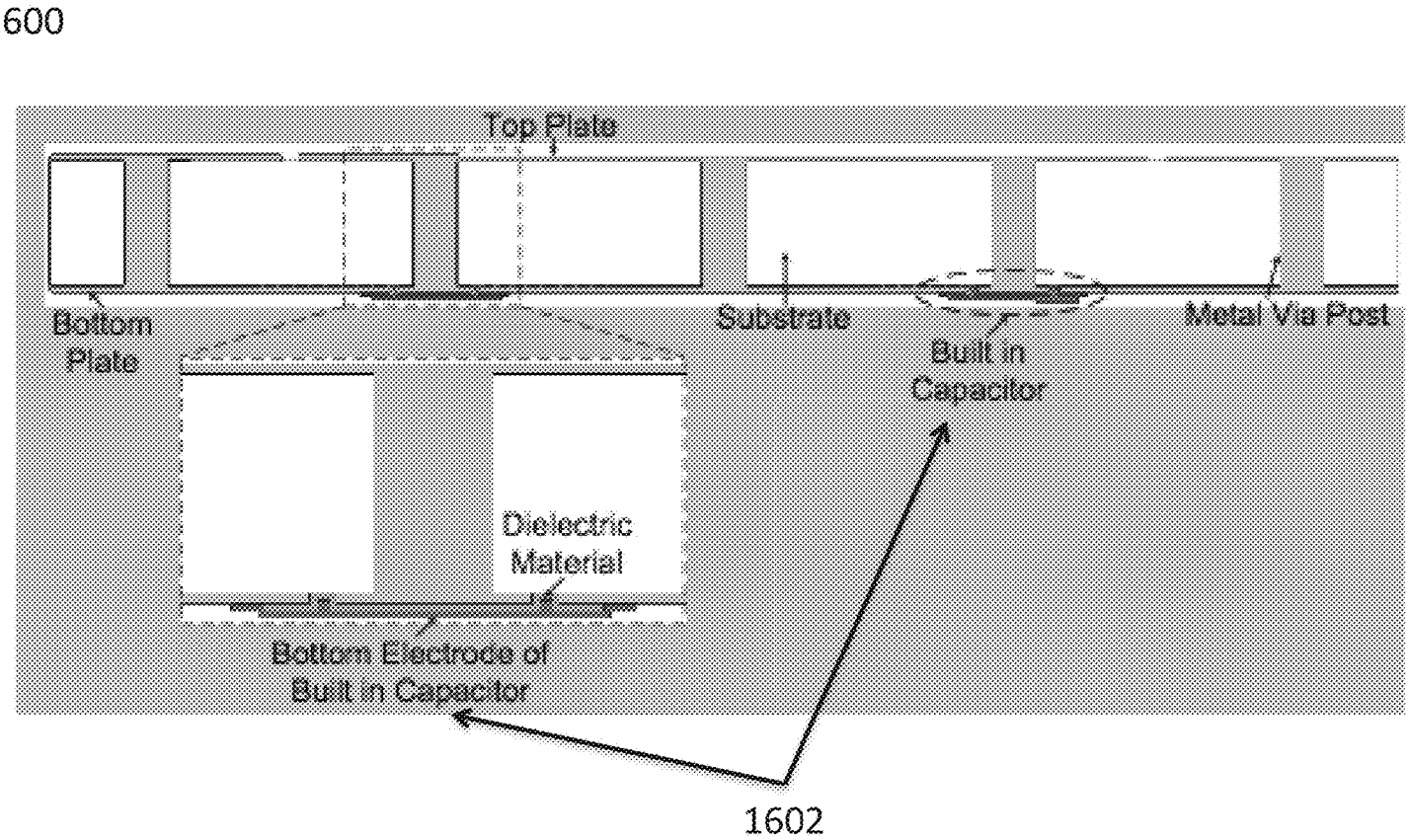
FIG. 16*b* illustrates a cross section view of the filter depicted in FIG. 16*a*.
Figure 16C:
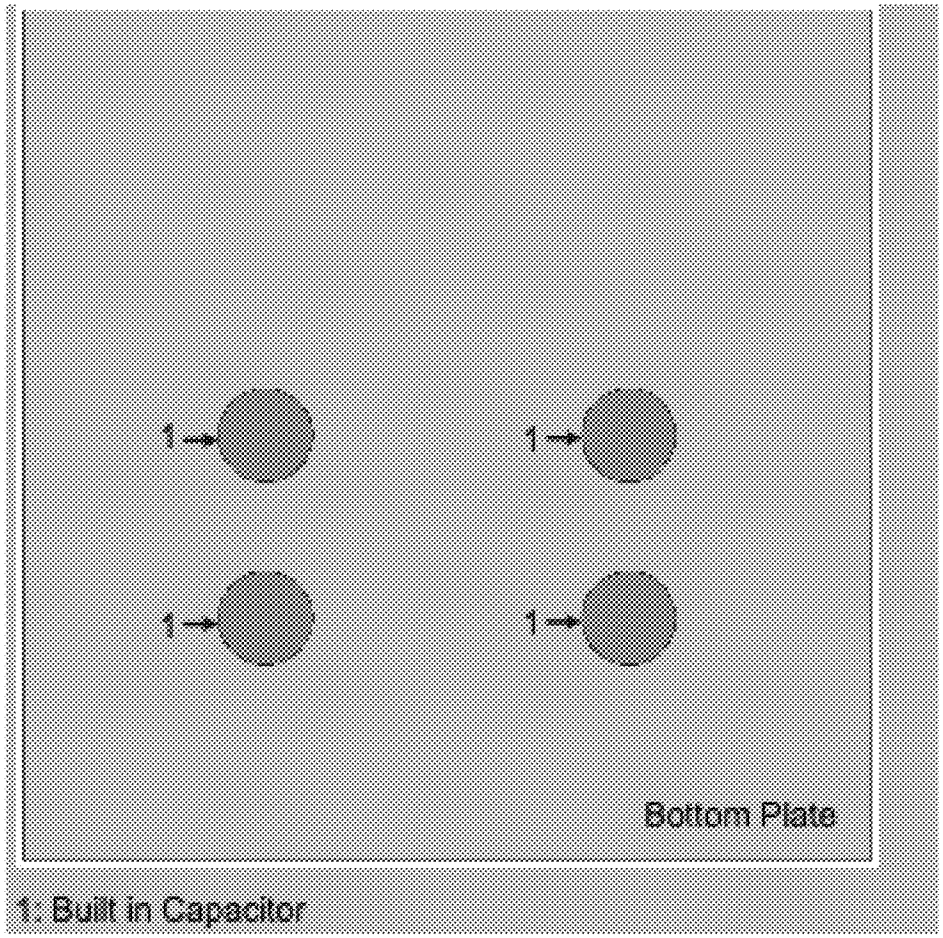
FIG. 16*c* illustrates a bottom view of the filter depicted in FIG. 16*a*.

FIG. 16*a* illustrates a 3-dimensional schematic of a filter 1600 with built in capacitors directly on an EBG substrate, according to one embodiment of the present invention. FIG. 16*b* illustrates a cross section view of the filter 1600 depicted in FIG. 16*a*. FIG. 16*c* illustrates a bottom view of the filter 1600 depicted in FIG. 16*a*. It will be appreciated that the filter 1600 in FIG. 16*a* includes the same structures as depicted in FIG. 15*a*, with the exception of built in capacitors 1602 in FIGS. 16*a* and 16*b* rather than external components shown in FIG. 15*a*.

Experimental Results

Figure 17A:
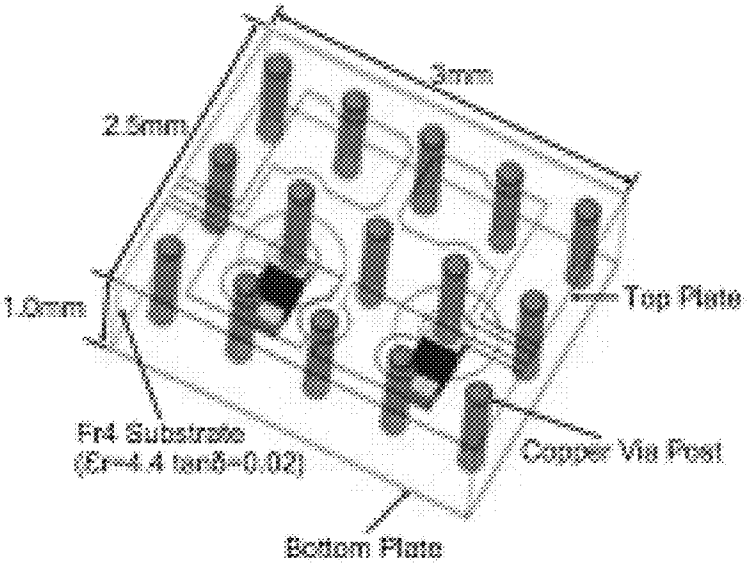
FIG. 17*a* illustrates an exemplary implemented EBG filter according to an embodiment of the present invention.
Figure 17C:
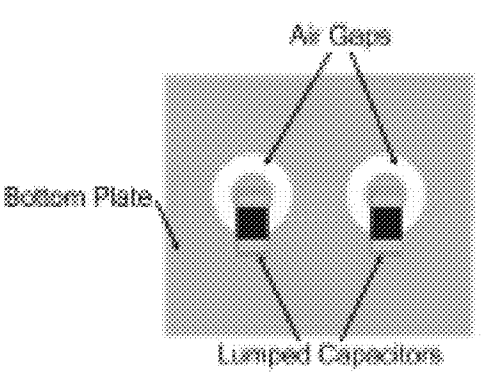
FIG. 17*c* illustrates a bottom view of the filter depicted in FIG. 17*a*.
Figure 17B:
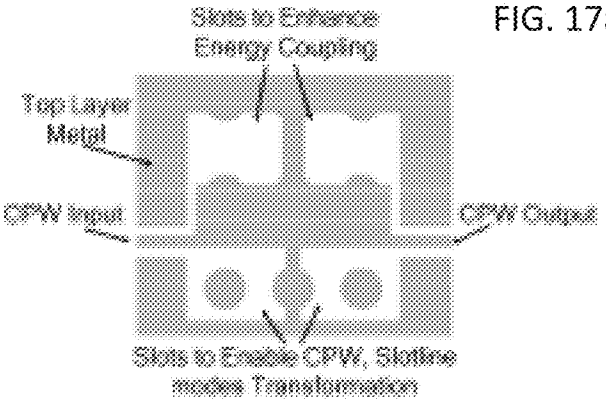
FIG. 17*b* illustrates a top view of the filter depicted in FIG. 17*a*.

FIG. 17*a* illustrates an exemplary implemented EBG filter according to an embodiment of the present invention. FIG. 17*b* illustrates a top view of the filter depicted in FIG. 17*a*. FIG. 17*c* illustrates a bottom view of the filter depicted in FIG. 17*a*.

The implemented filter 1700 includes energy transition and coupling circuits designed on a top copper layer of PCB. Electroplated copper via holes serve as the periodic lattice in the EBG materials and connect the top layer to the bottom layer. Two air gaps separating metal pads from surrounding ground plane are created by etching the bottom copper layer. The circuit utilizes CPW (co-planar waveguide) lines in the top plate to couple energy into the cavity defined by the EBG cavity walls. As shown in FIG. 17*b*, a cpw, slotline transition and coupling circuit is used for broadband performance and compact size. Rectangular slots are used instead of common slotlines to increase inductive reactance and therefore the stored magnetic energy at the end of the slot.

The two poles EBG filter of FIG. 17*a* is achieved by two coupled resonators and circular metallic rods placed in a rectangular lattice. The working frequency of the filter is determined by the external surface mounted capacitors. One row of via posts is designed in the filter of FIG. 17*a*, as opposed to typical EBG filters where multiple rows of via posts are used to confine energy inside the cavity for a high Q resonance. The filter of FIG. 17*a* is created by evanescent sections of the filter which confine fields inside the cavity. The small spacing between posts also contributes to an effective energy confinement.

Energy coupling between adjacent resonators is affected by the diameter of the via posts. As the post diameter increases from 100 um to 300 um, 1-dB fractional bandwidth of the filter changes from 9.41% to 4.19%. Post diameter of 200 um was used in the filter of FIG. 17*a* for achieving filter bandwidth of 5.7%.

The filter's 1700 performance is affected by its metallic loss due to induced currents in the metal surrounding the filter. The metallic loss is directly related to the filter's volume, which is effected by the substrate thickness. The thicker the substrate, the lower the loss would be. However, an allowable height of the substrate is limited by an onset of parasitic higher order modes, which corrupt bandgap properties and thus reduce spurious free range of the filter. A 1 mm thick substrate was used in the filter of FIG. 17*a* for ease in integration with other RF front-end components.

Figure 18B:
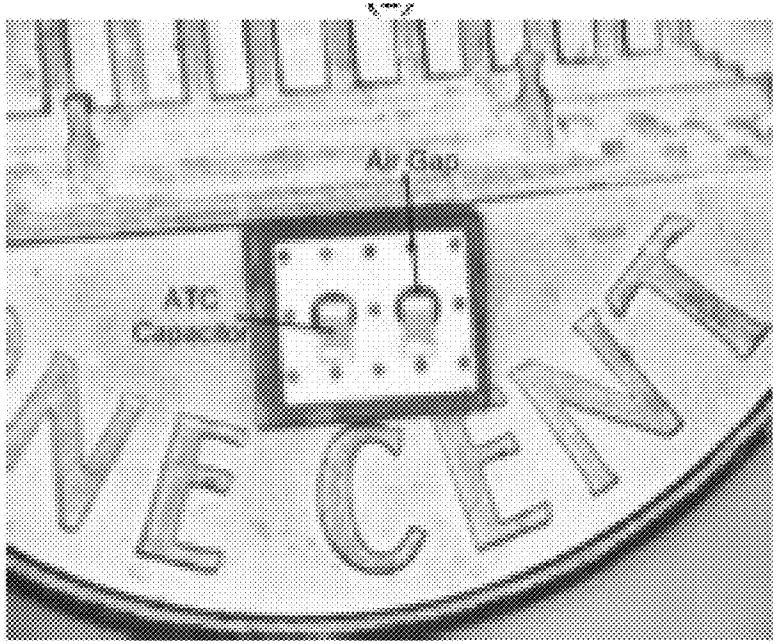
FIG. 18*b* is a bottom view photomicrograph of a fabricated filter depicted in FIG. 17*a*.
Figure 18A:
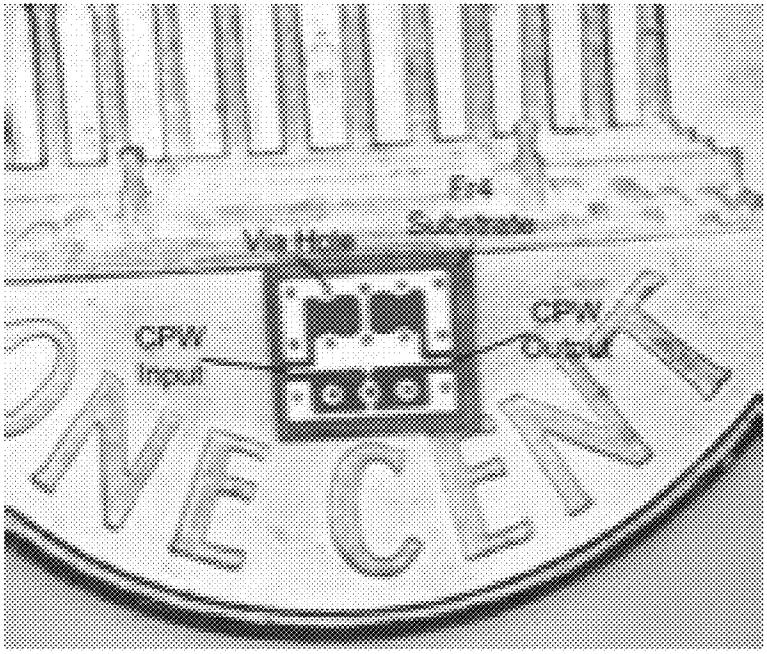
FIG. 18*a* is a top view photomicrograph of a fabricated filter depicted in FIG. 17*a*.

FIGS. 18*a* and 18*b* illustrate photomicrographs of a fabricated filter depicted in FIG. 17*a*. FIG. 18*a* is a top view of the filter and FIG. 18*b* is a bottom view of the filter. The filter of FIGS. 18*a* and 18*b* includes ATC600L series lumped capacitors. The filter is 2.50×3.00×1.00 $mm^3$ on Fr4 substrate. When the lumped capacitors are replaced by a varactor, a compact tunable filter with multiple frequency bands can be expected.

Figure 19:
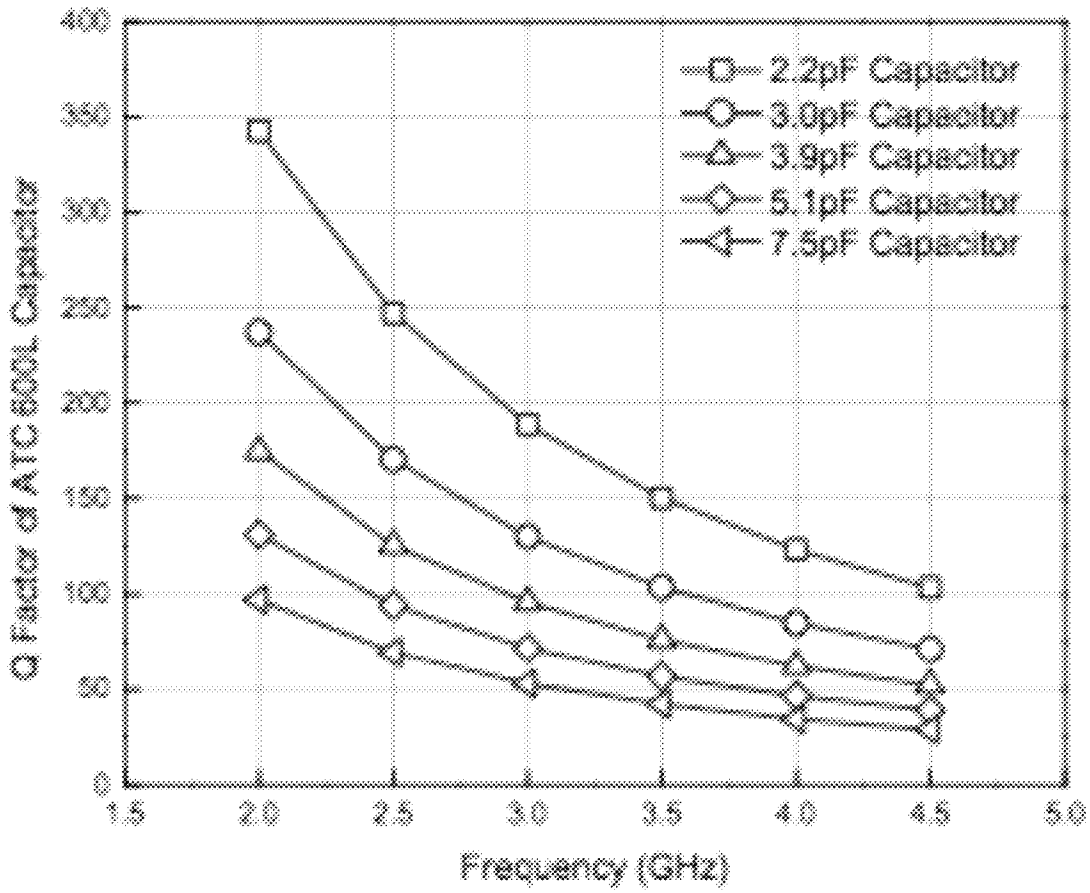
FIG. 19 illustrates Q factors of ATC 600L series capacitors at different frequencies.
Figure 20:
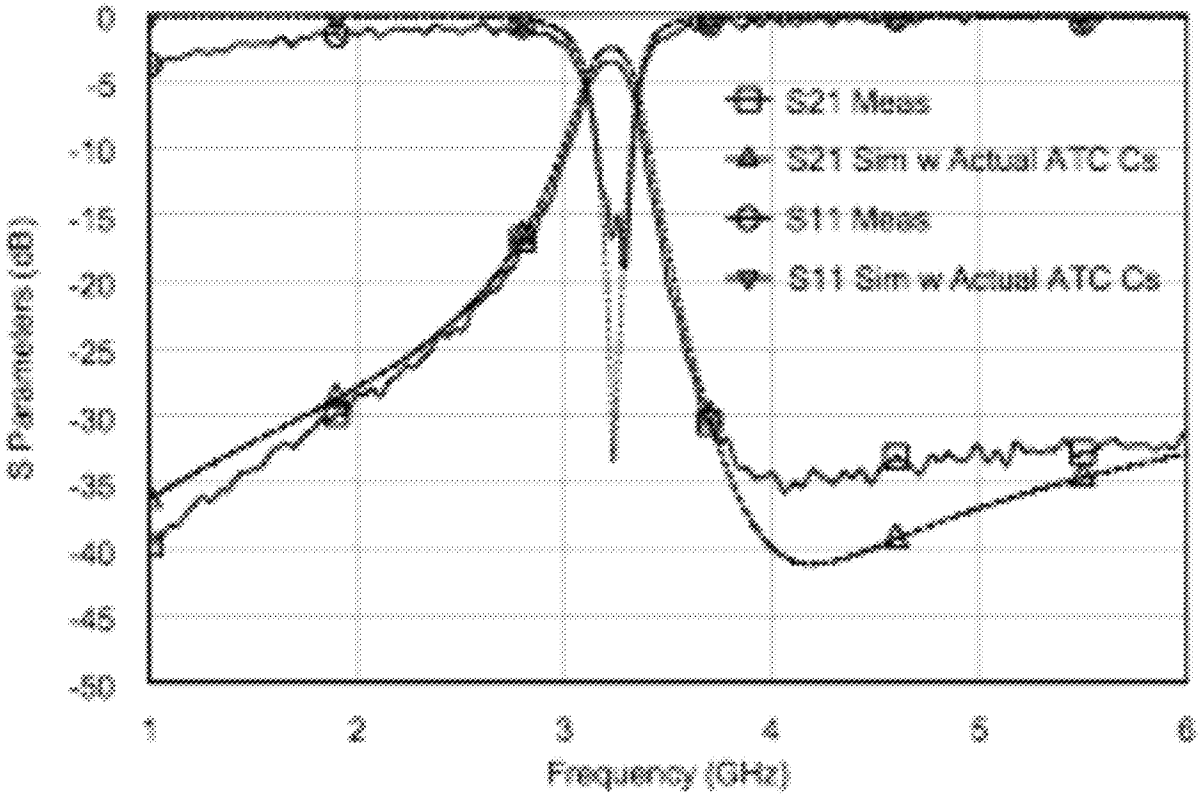
FIG. 20 illustrates a comparison of simulated and measured s parameters of the filter of FIGS. 18*a* and 18*b*.

FIG. 19 illustrates Q factors of ATC 600L series capacitors at different frequencies. FIG. 20 illustrates a comparison of simulated and measured s parameters of the filter of FIGS. 18*a* and 18*b*.

The capacitors of the filter of FIGS. 18*a* and 18*b* are 3.3 pf with Q of 91.9 at 3.5 GHz, mounted on the EBG substrate utilizing standard SMT technology. An extracted inductance of 0.069 nH was used. The measured frequency of the filter, as shown in FIG. 20, is 3.22 GHz.

The measured bandwidth of the filter in FIGS. 18*a* and 18*b* is 4.7% and the measured minimum insertion loss in the passband range is 3.48 dB at 3.22 GHz. The measured loss is dominated by the Q of lumped capacitors, which results in an effective filter Q of ~81. The maximum return loss in the passband is −18.91 dB. In these measured results, the lower band suppression in the frequency range from 1 MHz to 2.70 GHz and that in the upper band suppression range from 3.49 GHz to 10 GHz are higher than 20 dB.

Figure 21:
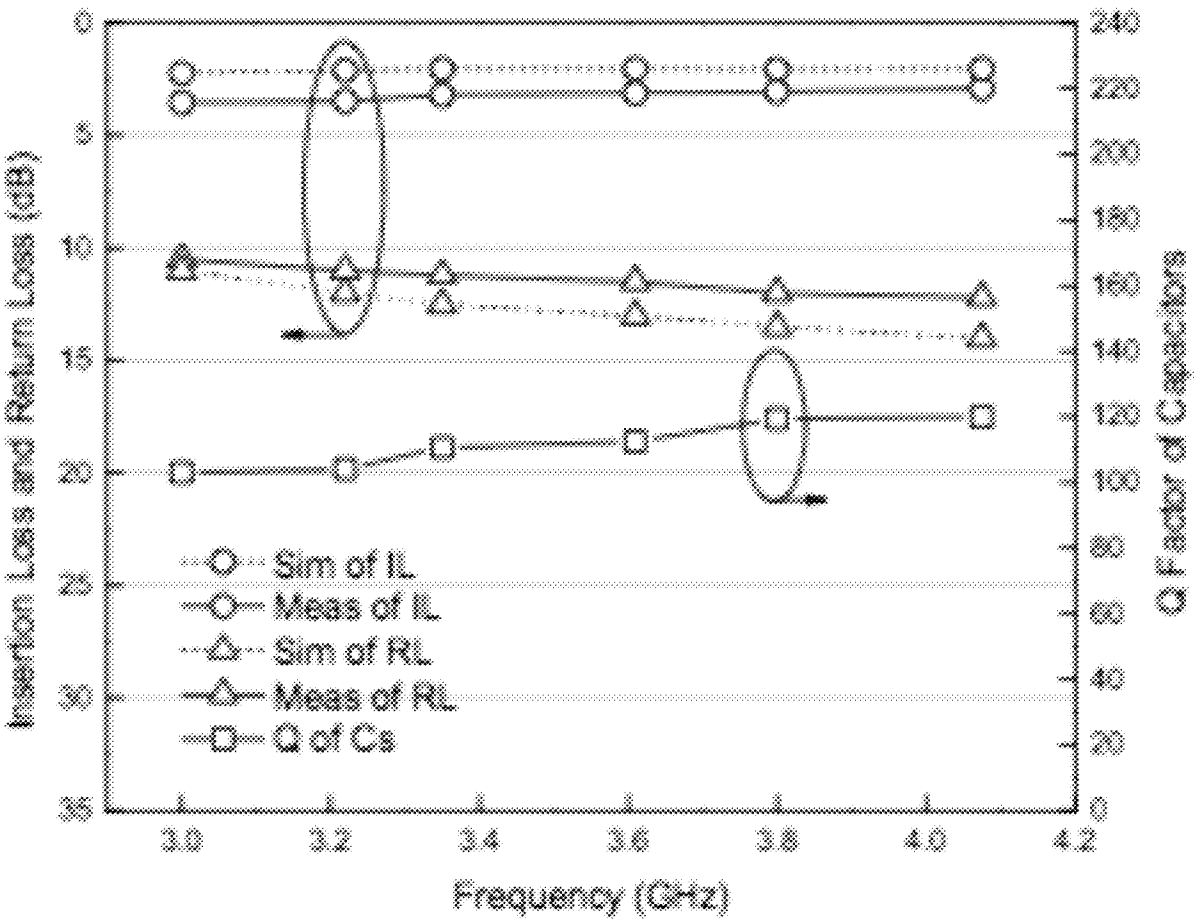
FIG. 21 illustrates a comparison of simulated and measured insertion and return losses of the filter of FIGS. 18*a* and 18*b* as well as corresponding Q factors of ATC capacitors at different frequencies.

FIG. 21 illustrates a comparison of simulated and measured insertion and return losses of the filter of FIGS. 18*a* and 18*b* as well as corresponding Q factors of ATC capacitors at different frequencies. As shown in FIG. 21, the measured insertion loss of the filter loaded by 2.2 pf capacitors is 2.93 dB at 4.07 GHz in comparison to that of a simulated one of 2.04 dB. The insertion losses are directly related with the Q factor of 2.2 pf capacitors at 4.07 Ghz. This different between simulated and measurement results is attributed to fabrication tolerances. When the filter is loaded by 3.6 pf capacitors, center frequency is 3.00 GHz. The Q factor of these capacitors is 104 and measured insertion loss is 3.56 dB. FIG. 21 shows that measured return losses are better than 10.8 dB from 3.00 GHz to 4.1 GHz.

Figure 22A:
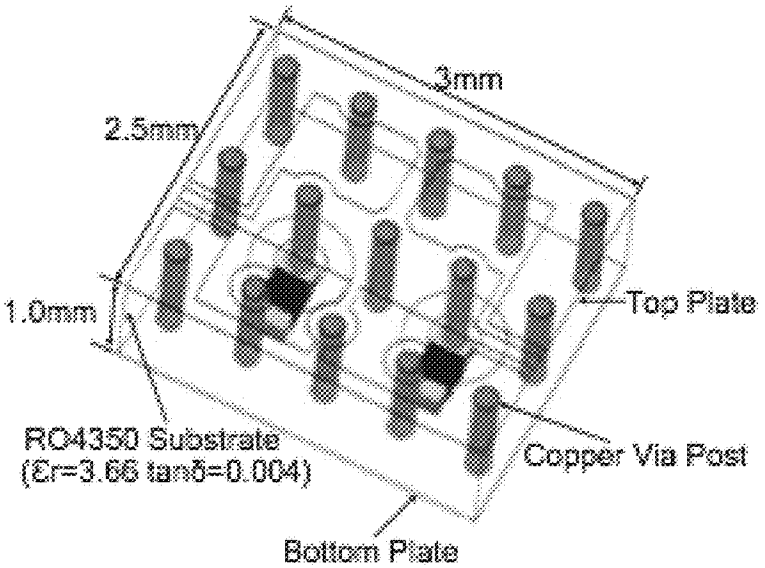
FIG. 22*a* illustrates an exemplary implemented EBG filter according to an embodiment of the present invention.
Figure 22C:
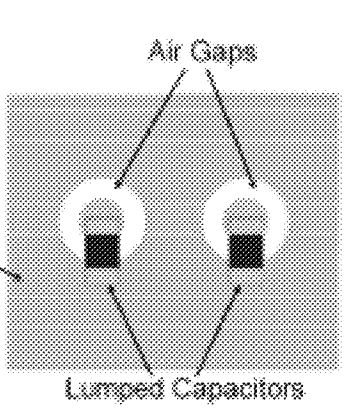
FIG. 22*c* illustrates a bottom view of the filter depicted in FIG. 22*a*.
Figure 22B:
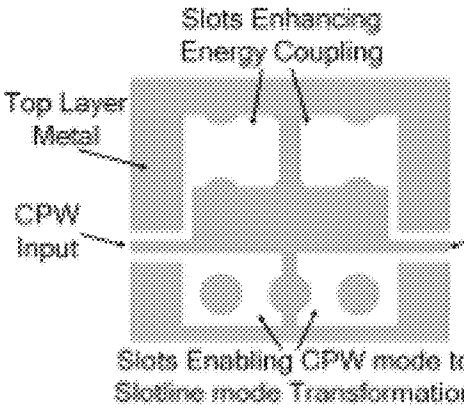
FIG. 22*b* illustrates a top view of the filter depicted in FIG. 22*a*.

FIG. 22*a* illustrates an exemplary implemented EBG filter according to an embodiment of the present invention. FIG. 22*b* illustrates a top view of the filter depicted in FIG. 22*a*. FIG. 22*c* illustrates a bottom view of the filter depicted in FIG. 22*a*. The design of the filter 2200 in FIGS. 22*a-c* follows a similar discussion as that depicted in FIGS. 17*a-c*.

Figure 23B:
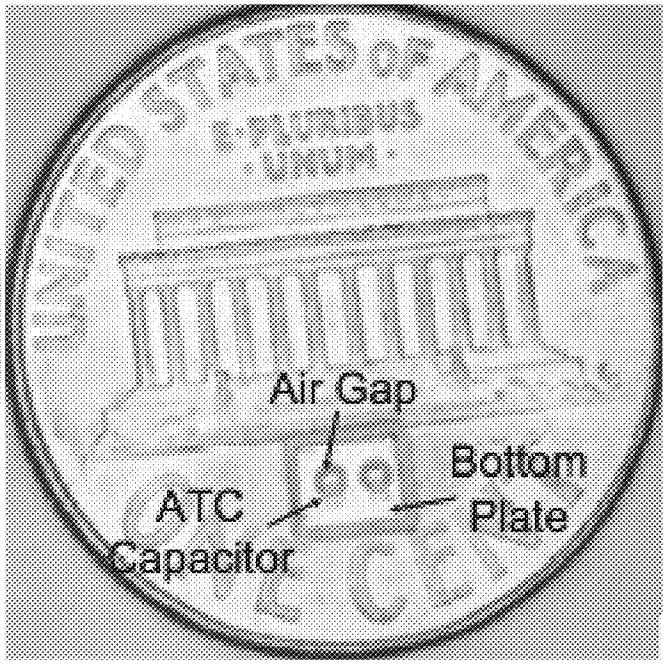
FIG. 23*b* is a bottom view photomicrograph of a fabricated filter depicted in FIG. 22*a*.
Figure 23A:
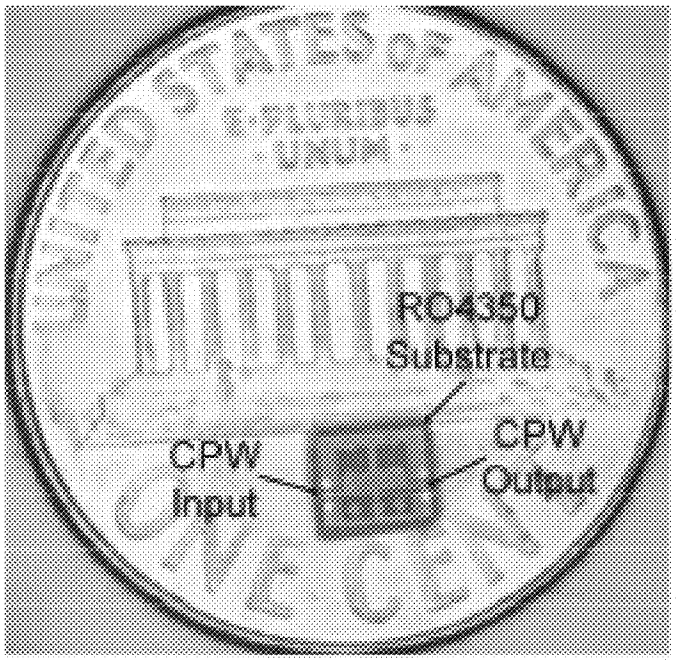
FIG. 23*a* is a top view photomicrograph of a filter depicted in FIG. 22*a*.

FIGS. 23*a* and 23*b* illustrate photomicrographs of a fabricated filter depicted in FIG. 22*a*. FIG. 23*a* is a top view of the filter and FIG. 23*b* is a bottom view of the filter. The filter of FIGS. 23*a* and 23*b* includes ATC600L series lumped capacitors. The filter is 2.50×3.00×1.00 $mm^3$ on RO4350 substrate. When the lumped capacitors are replaced by a varactor, a compact tunable filter with multiple frequency bands can be expected.

RO4350 substrate was chosen for its excellent high frequency characteristics due to low dielectric tolerance and loss.

Figure 24:
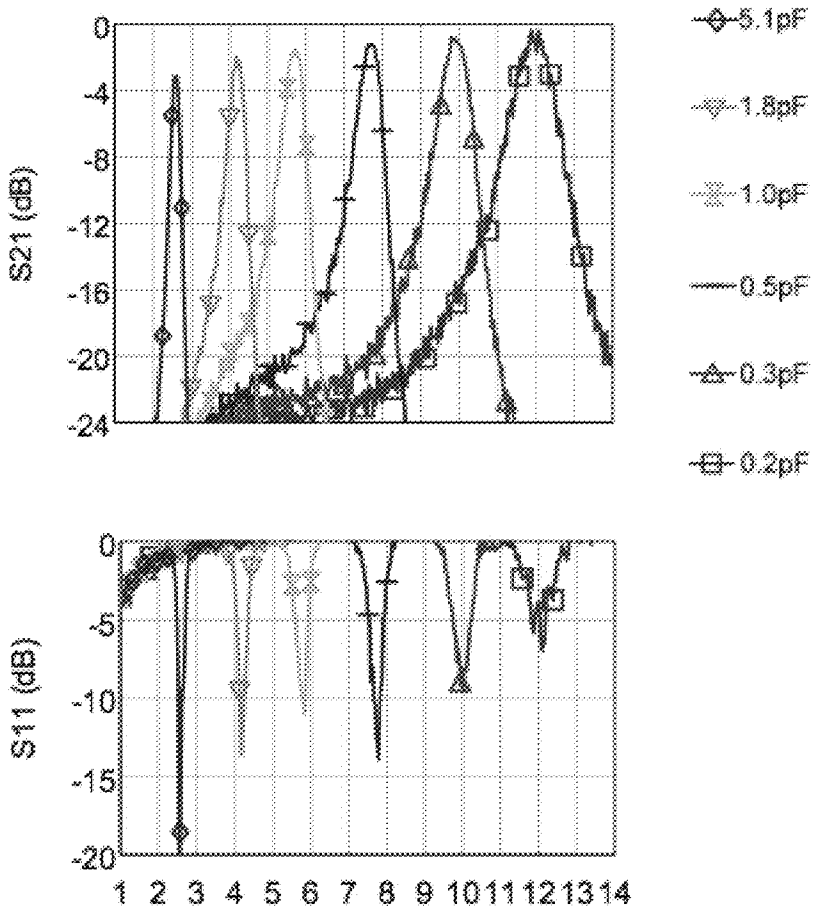
FIG. 24 illustrates measured s parameters of the filter depicted in FIGS. 23*a* and 23*b*.

FIG. 24 illustrates measured s parameters of the filter depicted in FIGS. 23*a* and 23*b*. The working frequency of the filter increases from 2.6 GHz to 12.0 GHz as the capacitor's value reduces from 5.8 pf to 0.2 pf. When the filter is loaded by different capacitors and working at different frequencies, the S21 varies from −3.34 dB to −1.48 dB as corresponding to surface mounted capacitors' Q factor increase from 89 to 172.4. Return loss curves of the filter are also shown in FIG. 24. From 2.5 GHz to 10 GHz, the S11 is better than −8 dB.

Figure 25:
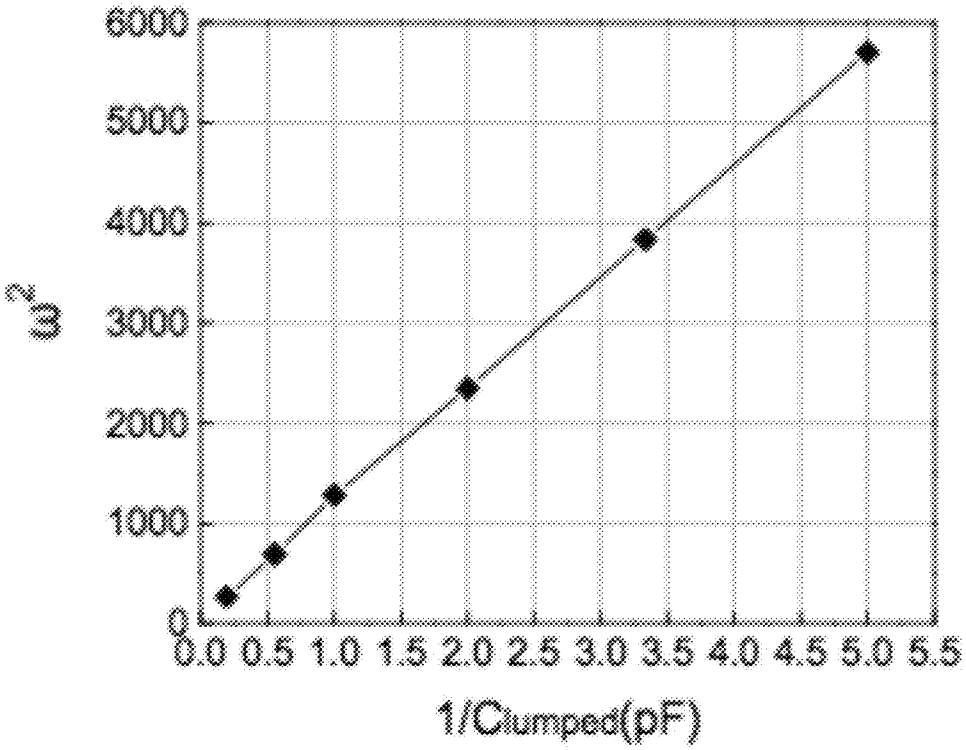
FIG. 25 illustrates the measured center frequency of the filter depicted in FIGS. 23*a* and 23*b*.

FIG. 25 illustrates the measured center frequency of the filter depicted in FIGS. 23*a* and 23*b*. The center frequency of the filter can be determined by using the following equation:

$$\omega = \frac{1}{\sqrt{L_{orig}(C_{orig} + C_{lumped})}}$$

where $C_{lumped}$ is the capacitance value of the surface mounted lumped capacitors, $L_{orig}$ and $C_{orig}$ are the original inductance and capacitance of the EBG cavity respectively.

Based on the above equation, $\omega^2$ is $1/C_{lumped}$ curve is extracted from the test results and shown in FIG. 25. $L_{orig}$ is determined by magnetic energy storage capability of the cavity and controlled by the thickness of the substrate and spacing between copper via posts. From FIG. 25 it is demonstrated that $L_{orig}$ is almost constant from 2.6 to 12.0 GHz which implies that the filter can work at any certain frequency within the range by simply choose surface mounted lumped capacitors.

Figure 26:
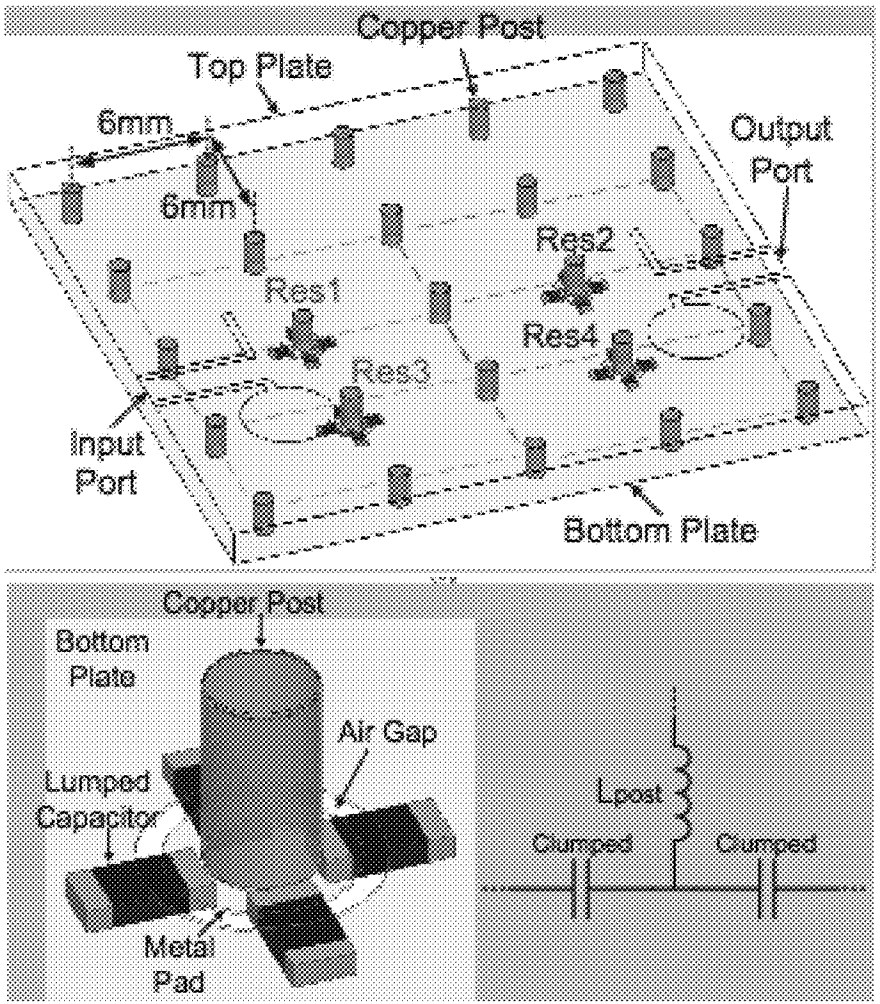
FIG. 26 illustrates a 3-dimensional schematic of a dual-band filter implemented on an EBG substrate, including an enlarged view of attached lumped capacitors and well as an equivalent LC circuit.

FIG. 26 illustrates a 3-dimensional schematic of a dual-band filter implemented on an EBG substrate, including an enlarged view of attached lumped capacitors and well as an equivalent LC circuit. The filter is combined by two single band filters made up of resonators. The first filter consists of two resonators working at the same frequency, and determines the first working frequency of band of the dual-band filter. The second single band filter is made up of two additional resonators working at the same frequency and contributing to the other frequency band. The four resonators share a common EBG substrate without having interference between them.

Figure 27A:
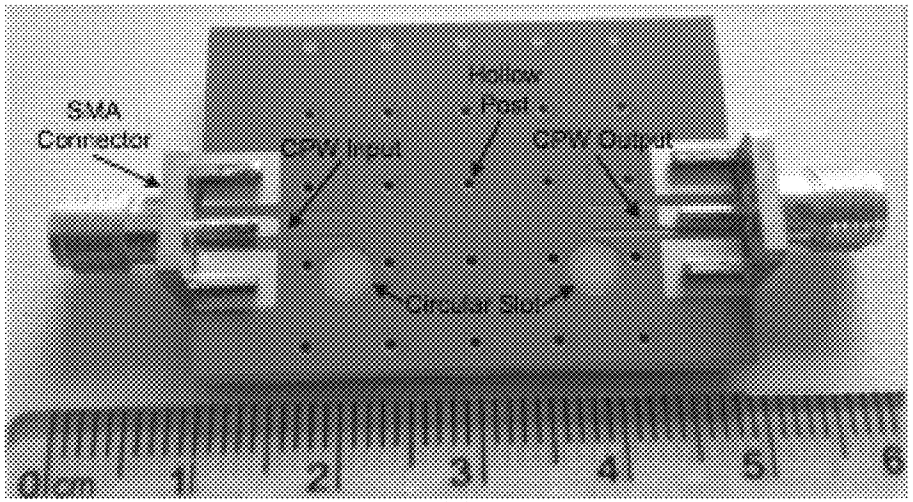
FIG. 27*a* is a top view photograph of a fabricated dual band filter according to the filter depicted in FIG. 26.
Figure 27B:
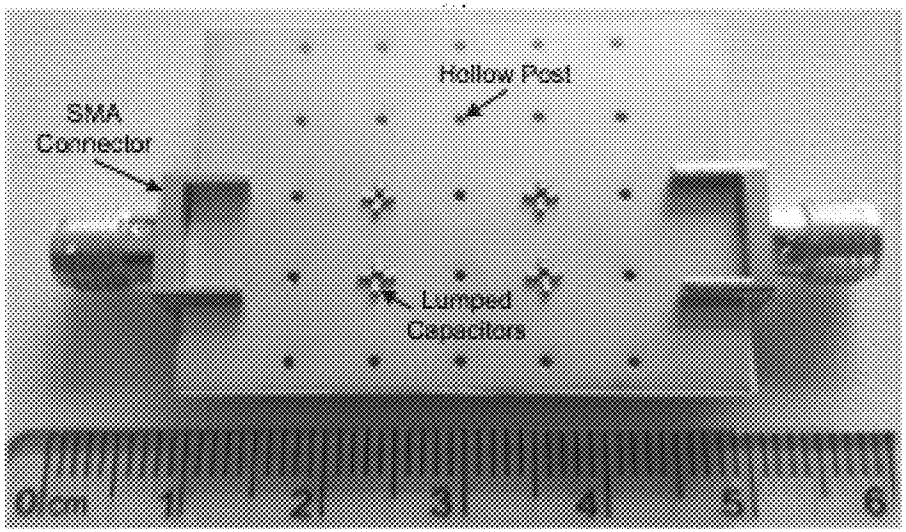
FIG. 27*b* is a bottom view photograph of a fabricated dual band filter according to the filter depicted in FIG. 26.

FIGS. 27*a* and 27*b* illustrate photographs of a fabricated dual band filter according to the filter depicted in FIG. 26. The fabricated dual band filter includes a Rogers RO4350 substrate with a dielectric constant of 3.66, a thickness of 1.524 mm and loss tangent of 0.004. A standard two layer metal PCB process is used to construct the metal via posts, top and bottom metal plates. ATC600L 0402 (0.5 mm×1.0 mm) series lumped capacitors are chosen for their small size and relatively high Q factor in implementation.

Figure 28:
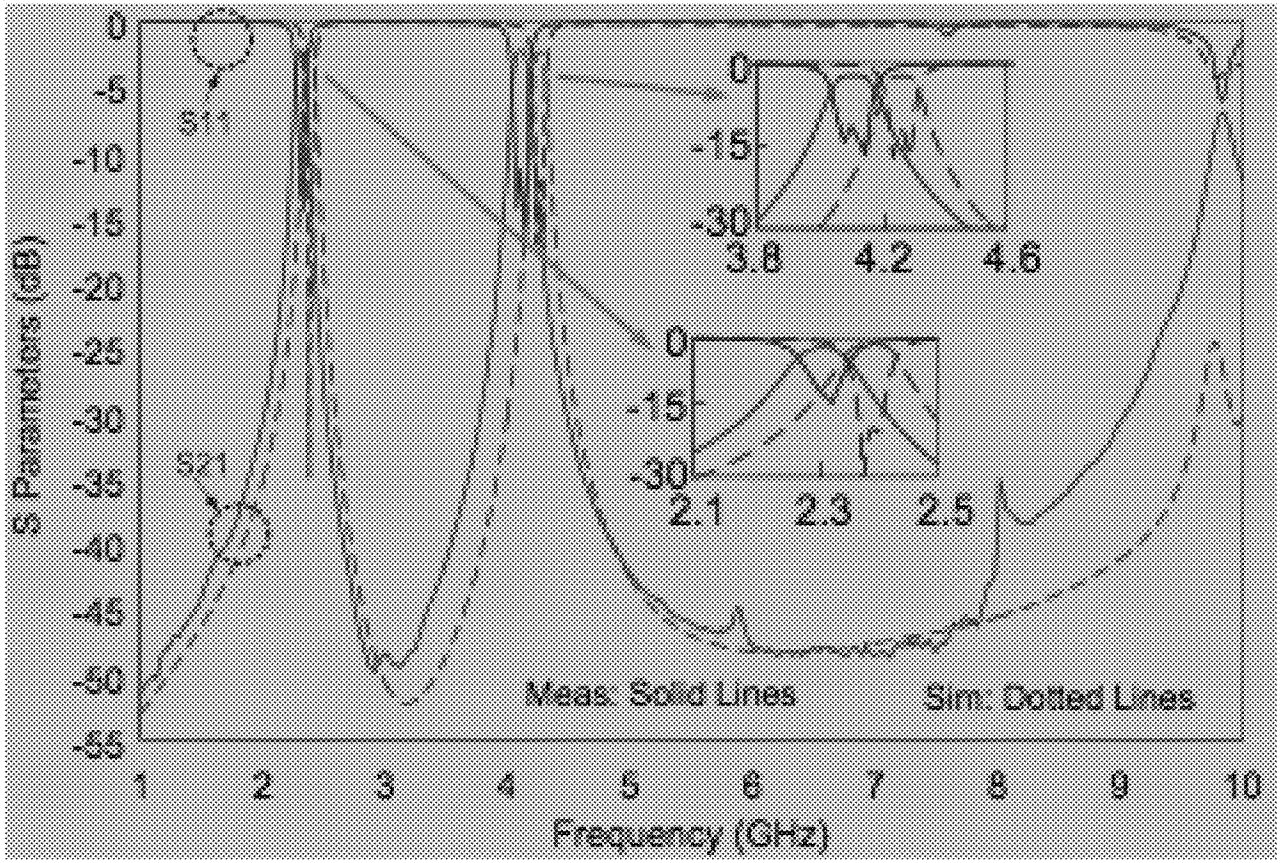
FIG. 28 illustrates simulated and measured results of s parameters of the filter depicted in FIGS. 27*a* and 27*b*.

FIG. 28 illustrates simulated and measured results of s parameters of the filter depicted in FIGS. 27*a* and 27*b*. The two passbands of the filter centered at 2.3 and 4.1 GHz have 1 dB fractional bandwidths of 2.3% and 2.5%, and measured minimum insertion losses of 2.18 dB and 2.24 dB, respectively. Two passband return losses are better than −14.0 dB. The measured loss is dominated by the Q of the lumped capacitors, which results in an effective Qu of 293 for the filter. The band to band isolation of the filter is better than 48.0 dB. The spurious signal suppression in the upper frequency band range from 4.5 GHz to 9.0 GHz is higher than 30 dB.

The filters presented herein exhibit numerous benefits. One of the benefits is the flexibly in selecting the components of the control elements. The control elements are shown as lumped components, but as described above, in other embodiments the control elements are provided as built in components and a plurality of tuning components. Each frequency of the presented multiband filter can be specifically selected on demand.

For 3-D evanescent mode (EVA) filters controlled by microelectromechanical system (MEMS), elaborate fabrication and integration technologies are needed to assemble those filters. For the filters presented herein, assembly constraints are alleviated.

Since the tuning frequency range of the filter depends on the external elements and since it does not rely on a via post size and height, the filter size can be significantly reduced. In comparison with EBG filter proposed before with a large size of 40.00 mm×30.00 mm×3.00 mm, a compact EBG filter of 2.50 mm×3.00 mm×1.00 mm with lattice period of 0.65 mm by 0.9 mm is described herein. The compact EBG filter described herein has a corresponding Qu of 80 to 150.

The design with external elements presented herein allows for easier integration of the filter not only with other components in a system-in-a-package solution, but also for an increased degree of design freedom.

The filters presented herein are integrated in an industry-standard printed circuit board ("PCB") substrate with commercially-available control components, thereby facilitating high-volume manufacturing, ease of integration with other RF front-end components, and lower fabrication cost.

Compared with planar designs, such as microstrip resonators/filters, the present design retains the high Qu of cavity resonators and wide spurious free region.

The filter presented herein does not require modification of a periodic lattice in the EBG substrate, therefore it doesn't suffer the working frequency band limitation. Due to the utilization of EBG substrate and external elements, an ultra wide working frequency range is covered by the filter.

The multiband filter presented herein demonstrates a band to band isolation better than 48 dB. The multiband filter also has a size smaller than that of a single band filter of previous disclosures, can work at multiple frequency bands and individual band performance is no compromised.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

In the description above, for purposes of explanation only, specific nomenclature is set forth to provide a thorough understanding of the present disclosure. However, it will be apparent to one skilled in the art that these specific details are not required to practice the teachings of the present disclosure.

The various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter.

It is understood that the embodiments described herein are for the purpose of elucidation and should not be considered limiting the subject matter of the disclosure. Various modifications, uses, substitutions, combinations, improvements, methods of productions without departing from the scope or spirit of the present invention would be evident to a person skilled in the art. For example, the reader is to understand that the specific ordering and combination of process actions described herein is merely illustrative, unless otherwise stated, and the invention can be performed using different or additional process actions, or a different combination or ordering of process actions. As another example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

What is claimed:

1. A cavity resonator or filter comprising
an electromagnetic bandgap (EBG) substrate, and
a built-in controlling assembly having a plurality of components configured to change a working frequency of the cavity resonator or filter, wherein the plurality of built in components are configured to enable controllable capacitive or inductive coupling of the cavity resonator or filter.

2. The cavity resonator or filter of claim 1, further comprising
a top metal layer,
a bottom metal layer, and
a plurality of posts serving as a periodic lattice structure extending through the EBG substrate and connecting the bottom metal layer with the top metal layer.

3. The cavity resonator or filter of claim 2 wherein the periodic lattice structure and top and bottom metal layers defining a resonating cavity.

4. A controllable cavity resonator/filter comprising:
an energy input and output coupling structure,
a cavity structure, wherein the cavity structure comprises a substrate, first and second metal layers above and below the substrate, and an array of posts extending between the first and second metal layers,
a first controllable reactance structure, and
a second controllable reactance structure on the substrate.

5. The controllable cavity resonator/filter of claim 4 further comprising CPW and slotline structures are formed on the first metal layer of the cavity to enable input and output energy coupling.

6. The controllable cavity resonator/filter of claim 4, wherein the first controllable reactance structure comprises a plurality of built in elements.

7. The controllable cavity resonator/filter of claim 6, wherein the built in elements are configured to controllably change the reactance between a first reactance and a second reactance.

8. The controllable cavity resonator/filter of claim 4, further comprising
a cap structure, and
a plurality of capacitive or inductive control elements.

9. The controllable cavity resonator/filter of claim 8, wherein the cap structure includes a first portion spaced apart from a second portion by a gap space.

10. The controllable cavity resonator/filter of claim 9, wherein the post structure extends between the substrate and the first portion of the cap structure.

11. The controllable cavity resonator/filter of claim 10, wherein the capacitive or inductive control elements can be lumped elements, built in elements or a plurality of tuning elements at least partially located in the gap space.

12. The controllable cavity resonator/filter of claim 4, wherein the controllable reactance structure comprises a plurality of external elements that interface with the cavity structure.

13. The controllable cavity resonator/filter of claim 12, wherein the external elements are configured to controllably change the reactance between a first reactance and a second reactance.

14. The controllable cavity resonator/filter of claim 12, wherein the working frequency of the cavity resonator/filter is a function of the reactance and the post impedance.

15. The controllable cavity resonator/filter of claim 12, further comprising an interface structure comprising a metal pad separated from surrounding metal by gaps and formed on a housing of the cavity structure.

16. The controllable cavity resonator/filter of claim 15, wherein the external elements are connected to the metal pad.

17. The controllable cavity resonator/filter of claim 15, wherein at least one post of the array of posts of the cavity structure connects with the metal pad.

18. The controllable cavity resonator/filter of claim 17, wherein a post impedance is a function of the at least one post.

* * * * *